US012806677B2

(12) United States Patent
Moser et al.

(10) Patent No.: US 12,806,677 B2
(45) Date of Patent: Nov. 24, 2026

(54) METHOD FOR PRODUCING CONICAL METAL OBJECTS MADE OF THIN SHEET METAL

(71) Applicant: Adval Tech Holding AG, Niederwangen (CH)

(72) Inventors: Daniel Moser, Rapperswil (CH); Matthias Common, Liebefeld (CH)

(73) Assignee: Adval Tech Holding AG, Niederwangen (CH)

( * ) Notice: Subject to any disclaimer, the term of this patent is extended or adjusted under 35 U.S.C. 154(b) by 176 days.

(21) Appl. No.: 18/846,392

(22) PCT Filed: Mar. 7, 2023

(86) PCT No.: PCT/EP2023/055756
§ 371 (c)(1),
(2) Date: Sep. 12, 2024

(87) PCT Pub. No.: WO2023/174757
PCT Pub. Date: Sep. 21, 2023

(65) Prior Publication Data

US 2025/0196214 A1 Jun. 19, 2025

(30) Foreign Application Priority Data

Mar. 14, 2022 (EP) ..... 22161973

(51) Int. Cl.
*B21D 22/22* (2006.01)
*B21D 22/26* (2006.01)

(52) U.S. Cl.
CPC ..... *B21D 22/22* (2013.01); *B21D 22/26* (2013.01)

(58) Field of Classification Search
CPC .... B65D 85/8043; B21D 51/10; B21D 22/20; B21D 22/22
See application file for complete search history.

(56) References Cited

U.S. PATENT DOCUMENTS 3,695,084 A 10/1972 Siemonsen et al.
4,562,717 A * 1/1986 Shimizu ..... B29C 51/085 72/347
4,914,937 A * 4/1990 Bulso, Jr. ..... B21D 22/26 72/349

FOREIGN PATENT DOCUMENTS

EP 0 310 726 A1 4/1989
EP 3702061 A1 * 9/2020 ..... B21D 22/26
(Continued)

OTHER PUBLICATIONS

Translation EP-3702061-A1.*
(Continued)

*Primary Examiner* — Bobby Yeonjin Kim
(74) *Attorney, Agent, or Firm* — Sughrue Mion, PLLC

(57) ABSTRACT

A method for producing a component made of an aluminum sheet with a thickness from 0.05 to less than 0.08 mm and with a region which is curved and which is made of a pot-shaped blank. The method has at least the following steps: a drawing process in steps and a conical drawing process, wherein prior to the drawing process, a stamped piece is stamped from the flat sheet metal, and is shaped into the pot-shaped blank, the free circumferential edge being expanded in a conically curved manner; a circumferential radial flange and an axial cylindrical edge region are formed during the conical drawing process; and this is followed by a drawing process in which the expanded conical section is folded to a folded expanded section for a form-fitting connection, and the edge region and the expanded section are rolled in order to form a rolled edge.

19 Claims, 16 Drawing Sheets

(56) References Cited

FOREIGN PATENT DOCUMENTS

| | | | | |
|---|---|---|---|---|
| WO | WO-2016075318 A1 * | 5/2016 | ..... | B65B 29/022 |
| WO | WO-2018067013 A1 * | 4/2018 | ..... | A23F 5/262 |

OTHER PUBLICATIONS

International Search Report for PCT/EP2023/055756 dated May 30, 2023.
Written Opinion for PCT/EP2023/055756 dated May 30, 2023.

* cited by examiner

Fig. 12a
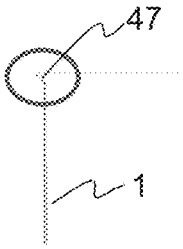
Fig. 12b
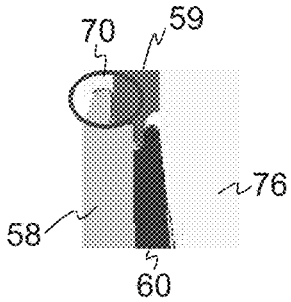
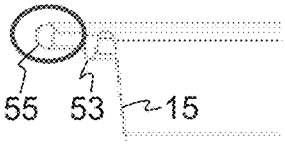
Fig. 12c
Fig. 13a
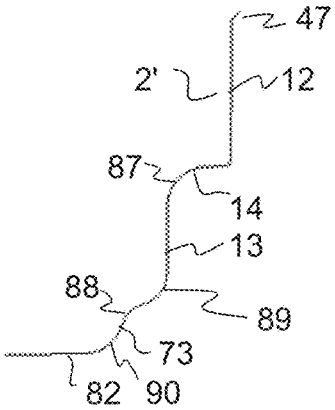
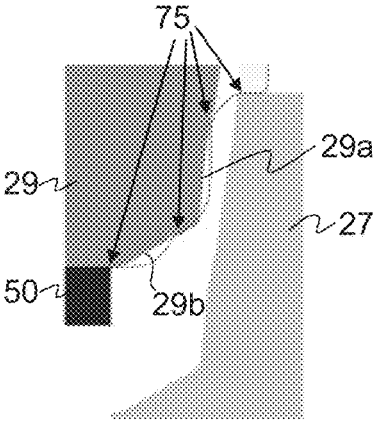
Fig. 13b
Fig. 13c
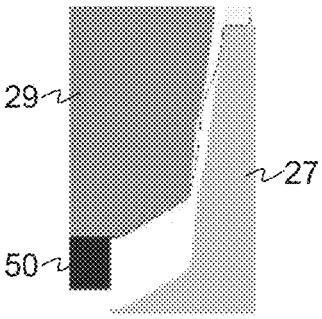
Fig. 13d
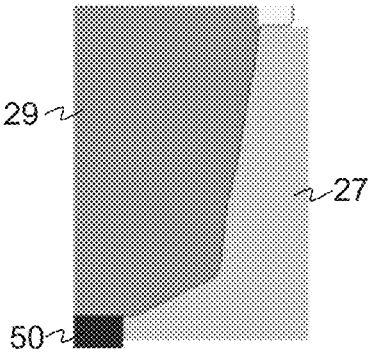
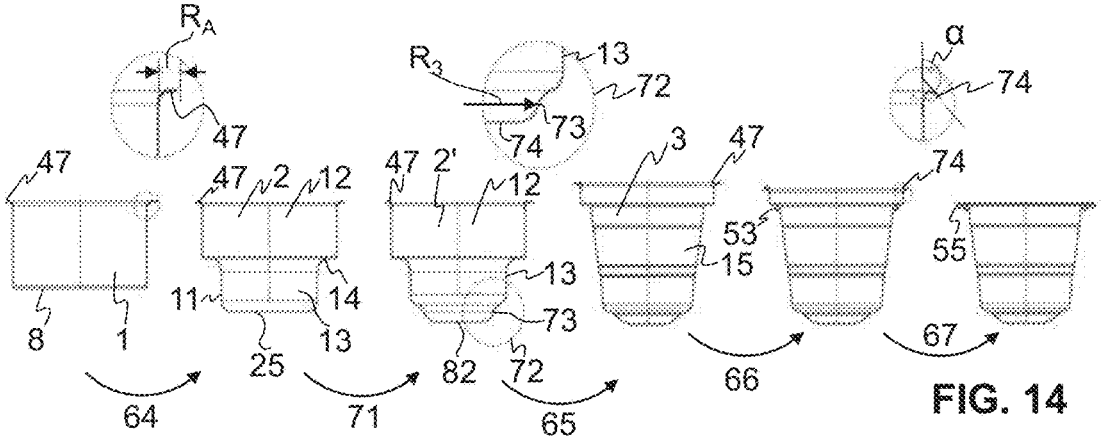
FIG. 14

METHOD FOR PRODUCING CONICAL METAL OBJECTS MADE OF THIN SHEET METAL

CROSS REFERENCE TO RELATED APPLICATIONS

This application is a National Stage of International Application No. PCT/EP2023/055756 filed Mar. 7, 2023, claiming priority based on European Patent Application No. 22161973.7 filed Mar. 14, 2022.

TECHNICAL FIELD

The present invention relates to methods for producing a component from a thin metal sheet, wherein the component has an at least partially curvedly or linearly conical region and is deformed proceeding from a pot-shaped blank having a substantially cylindrical wall portion, and to devices for carrying out such a method, and to components produced using the method. In particular, the method is suitable for the production of aerosol dome elements or capsules, in particular for food products, for example for coffee.

PRIOR ART

Pot-shaped articles consisting of metal can be deformed from a flat piece of sheet metal in a cold deformation process. This is typically performed after a stamping process or in combination with such a stamping process in a single deformation step (deep drawing), in which the final shape is imparted to the finished component. Such processes are used for example for the production of pots, spray cans (or parts thereof), components in the automotive industry or in the furniture industry, food product packaging, etc. As materials, use is made here in particular of aluminum and tin plate.

In particular if small material thicknesses are used, the deformation process must be performed carefully in order to avoid cracking, creasing etc. and resulting rejects or insufficient quality. This applies in particular to the formation of conical wall regions, because in this case, by contrast to the formation of axially cylindrical wall regions, guidance in the tool is not ensured to the same degree.

U.S. Pat. No. 4,914,937 describes a method for forming a tapering container, in which method the container is firstly drawn to a partial length, with first and second straight side wall portions that are connected to one another by a transition portion, and is then drawn again to substantially its final length and its tapering state by virtue of material being drawn out of the transition portion. The method optionally also includes a second redraw over the length, and a base profiling step that uses the over-drawn portion to form the profile.

EP-A-0310726 discloses a drawing process by means of a cylindrical punch and a frustoconical die. Here, the blank is subjected to one (or several) drawing operation(s) between a die having a frustoconical internal wall and a cylindrical punch, wherein the pressure of the work holder is reduced in order that the metal, as it is deformed, adapts to the shape of the punch. Said document also describes the use for the production of can bodies made of "double reduction" sheet.

EP-A-3702061 discloses a method for producing a component from a metal sheet, said component having an at least partially curvedly or linearly conical region from a pot-shaped blank having a substantially cylindrical wall portion. The method is characterized in that it comprises at least the following steps:

a step-forming drawing operation, in which the cylindrical rim portion of the blank is deformed, between a drawing die and a drawing punch that is guided movably in a blank holder, to form a stepped region having two cylinder portions, and at least one subsequent cone-forming drawing operation, in which at least the stepped region is deformed between two tools to form the curvedly or linearly conical component portion.

WO 2018/067013 describes a capsule containing a substance for the preparation of a drinkable beverage, wherein the capsule has a capsule body consisting of aluminum, said capsule body having a side wall, an outwardly extending flange, and a seal element on the outwardly extending flange for the purposes of making fluid-tight contact with a surrounding element of a preparation device. The beverage preparation device comprises an annular element having a free contact end that may be provided with a plurality of radially extending open grooves. The seal element is integral with the outwardly extending flange and has a projection. An annular trough between the inner projection foot and the side wall has a base that is axially spaced from the outer projection foot to the base of the capsule body.

SUMMARY OF THE INVENTION

The known methods have the problem, inter alia, that they are suitable only above a particular material thickness. If the material thickness is reduced further, for example in order to save material, to be more ecologically sustainable or to satisfy other requirements, problems arise, including cracking, uncontrolled shape formation, etc.

Accordingly, it is an object of the present invention to provide a method for producing a component from an aluminum sheet with a thickness in the range from 0.05 to less than 0.08 mm, which component has an at least partially curvedly or linearly conical region, from a pot-shaped blank having a substantially cylindrical wall portion.

The proposed method is in particular characterized in that it comprises at least the following steps:

A step-forming drawing operation, in which the cylindrical rim portion of the blank is at least partially deformed, between a drawing die and a drawing punch that is guided movably in a blank holder, to form a stepped region having two cylinder portions, a first cylinder portion having a substantially axially extending encircling wall with a first radius and a second cylinder portion following said first cylinder portion along a component axis and having a substantially axially extending or conically converging encircling wall with a second radius that is smaller than the first radius.

Here, the first and the second cylinder portion are encirclingly connected via a transition portion of the stepped region, which transition portion extends substantially radially or conically converges more acutely than the second cylinder portion.

In the step-forming drawing operation, the first cylinder portion is, at least in certain regions, guided internally by the blank holder and clamped between the blank holder and the drawing die, and the second cylinder portion is deformed by the drawing punch.

There is also at least one directly or indirectly subsequent cone-forming drawing operation, in which at least the transition portion and the second cylinder portion of the stepped region are deformed between two tools to form the curvedly or linearly conical component portion. The two tools are formed here at least by a cone-forming drawing operation drawing die and a cone-forming drawing operation drawing punch that is guided movably in a cone-forming drawing operation centering sleeve, and, in the cone-forming drawing operation, the first cylinder portion is, at least in certain regions, guided internally by the cone-forming drawing operation centering sleeve or clamped and/or guided between the cone-forming drawing operation centering sleeve and the cone-forming drawing operation drawing die. The transition portion and the second cylinder portion and the transition portion are deformed between the cone-forming drawing operation drawing punch and cone-forming drawing operation drawing die.

Here, before the step-forming drawing operation, a circular stamped piece is stamped out of a flat metal sheet, and said stamped piece is deformed in a subsequent deformation step to form the pot-shaped blank having a cylindrical wall portion with a blank radius, wherein the free encircling edge of the pot-shaped blank is at least partially of curvedly conically flared form (wherein this conical flare in this case includes a radially extending flange having a fold angle $\alpha$ of up to 90° with respect to the axial opening direction of the component).

Furthermore, in the cone-forming drawing operation, an encircling radial flange and an axial cylindrical rim region are formed at an opening side.

According to a first aspect of the present invention, the method is characterized in that, following the cone-forming drawing operation, a drawing operation is performed in which the conical flare of the free encircling edge (at least the outermost rim region thereof) is form-fittingly folded over to a fold angle $\alpha$ of at least 100° to form a folded-over flare. Following the formation of the folded-over flare, the axial cylindrical rim region and the folded-over flare are rolled at a base side, to form a rolled rim, in a rim rolling operation by means of a rolling punch, wherein the rolled rim preferably protrudes both at a base side and at an opening side beyond the plane of a flange formed in the cone-forming drawing operation.

According to a first preferred embodiment, the method is characterized in that, in the cone-forming drawing operation, an encircling radial flange and an axial cylindrical rim region are formed at an opening side, and, following the cone-forming drawing operation, a groove-forming drawing operation is performed in which an encircling bead directed toward the base is formed between a shaped piece and a die, optionally in combination with a further shaped piece, and at the same time the conical flare of the free encircling edge is form-fittingly folded over to a fold angle $\alpha$ of at least 90° to form a folded-over flare, and in a next step following the formation of the bead and the folded-over flare, the axial cylindrical rim region and the folded-over flare are rolled at a base side, to form a rolled rim, in a rim rolling operation by means of a rolling punch, wherein the rolled rim protrudes both at a base side and at an opening side beyond the plane of the flange.

It is furthermore possible and preferable that, in the (groove-forming) drawing operation, the conical flare of the free encircling edge is form-fittingly folded over to a fold angle $\alpha$ of at least 110°, preferably at least 120°, to form a folded-over flare, wherein the folded-over region is flat or preferably curved in the direction of curvature of the adjoining rolled rim.

The conical flare typically has a radial width in the range from 0.5-2 mm, preferably in the range from 1-1.7 mm.

The method can be performed particularly efficiently and reliably if it is characterized in that, in the (groove-forming) drawing operation, the conical flare is held form-fittingly between a folding punch and a die and is rolled to form the folded-over flare.

According to a second aspect of the present invention that may be used independently of the first aspect of the present invention as mentioned above, but is preferably used in combination with the first aspect, the method is characterized in that, between the step-forming drawing operation and cone-forming drawing operation, a further intermediate drawing operation is performed in which the stepped region having two cylinder portions, the first cylinder portion having a substantially axially extending encircling wall with a first radius and the second cylinder portion following said first cylinder portion along a component axis, adjoining the base and having a substantially axially extending or conically converging encircling wall with a second radius that is smaller than the first radius, is deformed such that a further step is formed from the base or from the base and the transition between base and second cylinder portion, which further step has a cone portion or third cylinder portion, the radius of which is smaller than the second radius.

In particular by means of this additional intermediate drawing operation, when using the claimed thin material but also in conjunction with starting materials in the form of aluminum sheets with a thickness in the range from 0.05 to 0.1 mm, cracks and rejects can be substantially prevented.

Cracks in the material of the component can be prevented in particular if, in the further intermediate drawing operation, a third cylinder portion is formed, and in the further intermediate drawing operation and/or in the step-forming drawing operation, the height $h_1$ and the radius $R_2$ of the second cylinder portion, and in the intermediate drawing operation, the height $h_2$ and the radius $R_3$ of the third cylinder portion, are selected such that, in the cone-forming drawing operation, the convex internal curvature regions of the component come into contact with the external contour of the cone-forming drawing operation drawing punch substantially from the outset, and the convex external curvature regions of the component come into contact with the internal contour of the drawing die of the cone-forming drawing operation substantially from the outset.

Here, the height $h_1$ of the second cylinder portion is preferably set to be a multiple, in the range from 0.8-1.2, of the height ha of the third cylinder portion.

The radii of the second and of the third cylinder portion are defined by the angle of the cone-forming drawing operation resulting from the specified abutment of the tool against the curvature regions.

Owing to the targeted structuring of the component or of the mold used in the further intermediate drawing operation such that, during the subsequent cone-forming drawing operation, the punch and die make contact at the corresponding contact points from the outset and remain in contact throughout the entire cone-forming drawing operation, optimum material guidance is ensured, and cracks are avoided. It is thus possible for even thinner material to be used, in particular within the scope of the claimed thickness in the range from 0.05 to less than 0.08 mm, or, if thicker material as described above is used, rejects can be reduced significantly further.

Particularly few cracks and rejects are generated if the dimensions (height and radii of the steps of the second and third cylinder portions) are set such that, in the cone-forming drawing operation, the base of the component comes into contact with the lower surface of the cone-forming drawing operation drawing punch substantially from the outset. Thus, in the cone-forming drawing operation, controlled contact between the component for processing and the tool is realized at multiple surfaces from the outset. By means of the base of the cone-forming drawing operation drawing punch, that is to say by means of the lower surface thereof, the material of the component is drawn into the die.

Such a method may furthermore preferably be characterized in that, in the further intermediate drawing operation, the transition portion and the second cylinder portion are held form-fittingly between a blank holder and the drawing die, and the cone portion is formed by virtue of a drawing punch that is guided in the drawing die plunging into the base. Typically, the transition portion extends substantially encirclingly radially, and the respective encirclingly extending walls of the first and of the second cylinder portion extend substantially encirclingly axially.

It is furthermore possible that that the cone-forming drawing operation centering sleeve is formed as a blank holder which, during the cone-forming drawing operation, clamps the first cylinder portion and/or the transition portion at least in certain regions between the cone-forming drawing operation blank holder and the cone-forming drawing operation drawing die.

In a further preferred embodiment, the method is characterized in that the ratio of the radius of the first cylinder portion to the radius of the second cylinder portion lies in the range from 2:1-1.1:1, preferably in the range from 1.6:1-1.25:1, particularly preferably in the range from 1.5:1-1.3:1.

It is additionally or alternatively preferable for the ratio of the radius of the first cylinder portion to the base radius of the second cylinder portion or of the cone portion to lie in the range from 2.5:1-1.2:1, preferably in the range from 2.0:1-1.4:1, particularly preferably in the range from 1.9:1-1.5:1.

It is furthermore preferable if the ratio of the axial length of the first cylinder portion to the axial length of the second cylinder portion or of the second cylinder portion and the cone portion lies in the range from 4:1-0.5:1, preferably in the range from 3:1-0.75:1, particularly preferably in the range from 2.5:1-1:1.

It is likewise preferable if the ratio of the radius of the second cylinder portion to the base radius of the cone portion lies in the range from 2.5:1-1.1:1, preferably in the range from 2.0:1-1.2:1, particularly preferably in the range from 1.9:1-1.3:1.

It is typically the case in the proposed method that, before the step-forming drawing operation, a preferably circular stamped piece is stamped, preferably in alternatingly transversely offset fashion, from a flat metal sheet that is preferably supplied in strip form, in particular from a roll, and said stamped piece is deformed in a subsequent deformation step to form the pot-shaped blank having a cylindrical wall portion with blank radius, wherein the free encircling edge of the pot-shaped blank is either folded over to form a radial flange or of curvedly conically flared form, wherein, preferably, the outer diameter of the flare is greater than the blank radius by 1-50 times the material thickness of the metal sheet, preferably, in the case of a curvedly conically flared encircling edge, greater than the blank radius by 2-20 or 5-15 times the material thickness of the metal sheet.

The blank advantageously consists of aluminum or an aluminum alloy with a tensile strength in the range from 80-120 MPa, in particular aluminum of the following types: EN AW-8011A, 8079, 8176, 8021, 8090, sintered 6061 or sintered 2014, in each case in uncoated form or painted, optionally in color, on one side or both sides.

The proposed method may furthermore be characterized in that the at least partially curvedly or linearly conical region forms, with the axis of symmetry of the component, an average angle in the range from 5-40°, preferably in the range from 7-15°, particularly preferably in the range from 8-12°.

The at least partially curvedly or linearly conical region is preferably linearly conical at least in certain regions, and preferably has exclusively linearly conical regions aside from any steps that may be provided.

In the cone-forming drawing operation or in one or more subsequent deformation steps, at the base side adjoining the at least partially curvedly or linearly conical region, there may be formed a further cylindrical or conical region that is preferably connected via a radial region.

In particular, preferably in the cone-forming drawing operation, at the base side adjoining the at least partially curvedly or linearly conical region, there is formed a further conical region, which further conical region, by comparison with the at least partially curvedly or linearly conical region, encloses a greater average angle with the axis of symmetry of the component, preferably a cone angle in the range from 30-80°, particularly preferably in the range from 50-70°.

The method may furthermore be characterized in that, in a transfer station, identical components are processed in parallel in the same stroke on multiple lines operating in parallel, preferably in at least two, particularly preferably 2-8, or 3-5, such parallel lines.

The rolling drawing operation may be followed by further processing steps, in particular selected from the following group: stamping steps; coating steps; application steps, in particular the application of inserts or attachment of seals; filling steps; quality control steps; cleaning steps; mounting steps on further components; wherein these further steps are preferably performed at least in part in the same transfer installation as step-forming drawing operation and cone-forming drawing operation.

The present invention furthermore relates to a device for carrying out a method as described above in the form of a transfer installation having at least one station for the step-forming drawing operation and at least one downstream station for the cone-forming drawing operation, at least one downstream station for the groove-forming drawing operation, and at least one downstream station for the rolling operation, wherein the tool for the step-forming drawing operation comprises a drawing die and a drawing punch that is guided movably in a blank holder, and, in the step-forming drawing operation, the first cylinder portion and/or the transition portion is clamped at least in certain regions between the blank holder and the drawing die, and the second cylinder portion and/or the transition portion is formed by the drawing punch, and wherein the tool for the subsequent cone-forming drawing operation comprises a cone-forming drawing operation drawing die and a cone-forming drawing operation drawing punch that is guided movably in a cone-forming drawing operation centering sleeve, and, in the cone-forming drawing operation, the first cylinder portion and/or the transition portion is guided and/or clamped at least in certain regions between the cone-forming drawing operation centering sleeve and the cone-forming drawing operation drawing die, and the transition portion and/or the second cylinder portion is formed between the cone-forming drawing operation drawing punch and cone-forming drawing operation centering sleeve.

The present invention finally relates to a component produced in a method as described above or in a device as described above.

Further embodiments are specified in the dependent claims.

BRIEF DESCRIPTION OF THE DRAWINGS

Preferred embodiments of the invention will be described below on the basis of the drawings, which serve merely for explanatory purposes and are not to be interpreted as limiting.

In the drawings:

FIG. 12*a*-FIG. 12*b* shows the upper rim region, wherein a) illustrates the folded-over portion after the cutting drawing operation or after the step-forming drawing operation in the case of the blank with the component after the step-forming drawing operation, b) illustrates the rim region in the tool for the groove-forming drawing operation, and c) illustrates the finished rim region of the capsule after the rolling drawing operation;

FIG. 13*a*-FIG. 13*d* shows the component after the further intermediate drawing operation during the cone-forming drawing operation, wherein a) illustrates the component after the further intermediate drawing operation in a partial section, b) illustrates said component at the start of the cone-forming drawing operation when the punch comes into contact with the component, c) illustrates the deformation process in the tool when the base structure has been deformed, approximately 8 mm before bottom dead center, and d) illustrates the tool, with the component held therein, at bottom dead center;

FIG. 14 shows the sequence of steps with the further intermediate drawing operation and the formation of the folded-over flare in the groove-forming drawing operation, wherein each of the regions circled in the lower sequence of steps is illustrated in detail at the top;

DESCRIPTION OF PREFERRED EMBODIMENTS

FIGS. 1-5 illustrate steps of the method proposed here on the basis of the various deformation operations on a component.

Figure 1:
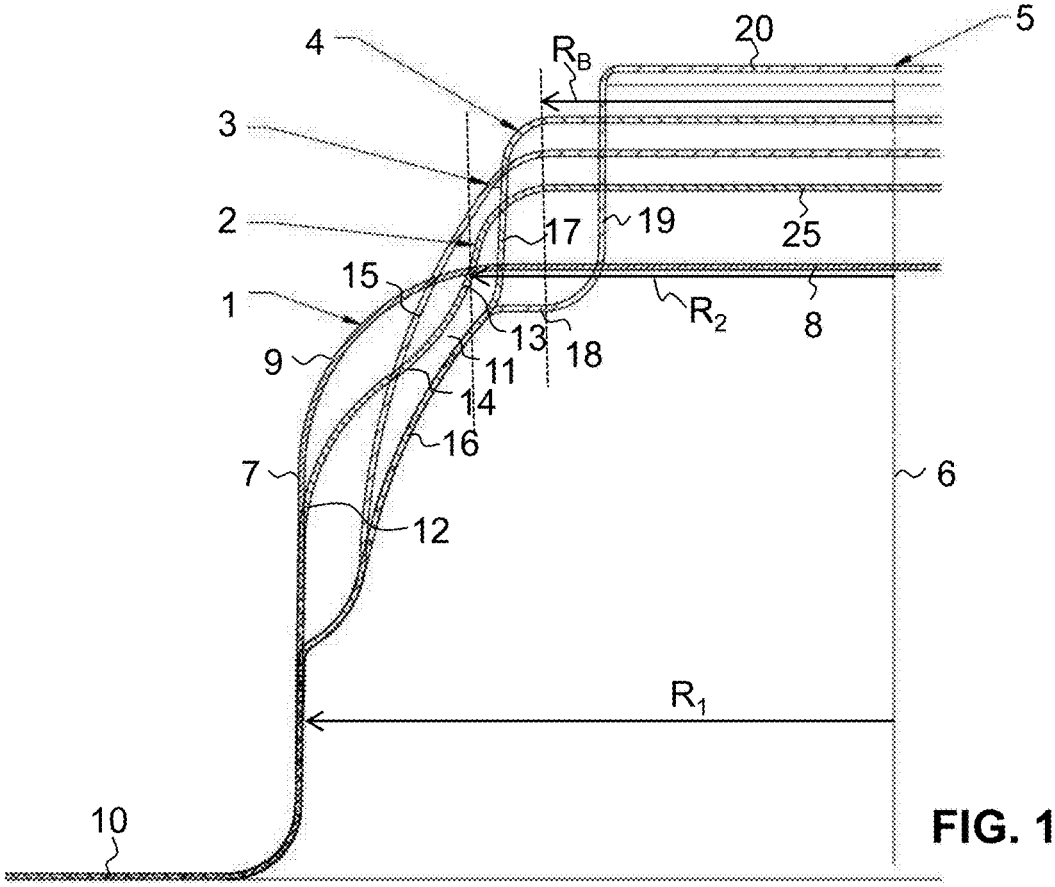
FIG. 1 shows an axial section through a workpiece in the various processing phases (aerosol dome)

FIG. 1 shows an axial section through the workpiece in the various processing phases. The illustration does not show the first phase, in which the flat sheet-metal portion, a stamped piece, is provided and shaped. In a first step, said stamped piece is deformed to form the blank 1, which blank 1 is of cylindrical pot-shaped form having a folded-over rim portion 10 in the form of a radial flange, followed by an encircling cylindrical portion 7 of radius $R_1$, and a curved portion 9 following said cylindrical portion 7, and the blank 1 is closed off at a base side by the base portion 8 that extends perpendicularly to the main axis 6, that is to say axially.

Said blank 1 is firstly deformed to form a stepped component 2 in a first deformation step, the intermediate drawing operation or step-forming drawing operation. Said stepped component then firstly has, at an opening side, a first cylinder portion 12, still having the radius $R_1$, which transitions via a curved transition portion 14 into a second cylinder portion 13 having a smaller radius $R_2$. The region of the transitions from 12 via 14 to 13 is also referred to as stepped region 11. The second cylinder portion 13 is followed, toward the base side, by an adjoining short curved region, and then, following the step-forming drawing operation, the base 25 of the component having a base radius $R_B$, which is defined as the radius of the flat region without the transition curvature to the second cylinder portion.

A second deformation step then follows, in which said component 2 is deformed in a first drawing operation, the actual cone-forming drawing operation, to form a conical component 3. In this cone-forming drawing operation, the previously stepped region 11 is deformed to form an in this case curvedly conical region 15. This curvedly conical region 15 is in turn followed by a base region. Here, the base radius $R_B$ remains unchanged.

Further drawing operation steps then follow; in a second drawing operation to form the component 4, the cone angle is increased, that is to say the cone is made to converge more acutely, and a cylindrical portion 17 is formed in the base-side region.

In a final drawing operation step, the component 4 is deformed further by virtue of the cylindrical region 17 being deformed to form a radial region 18, which is followed toward the base side by a cylindrical region 19; the component is closed off at the base side by the base 20. This component 5 after the third drawing operation is typically subsequently stamped in the base region, and further operations can then follow, such as the formation of a rolled rim etc.

The tools for implementing the intermediate drawing operation and cone-forming drawing operation to produce such a component are illustrated in FIGS. 2-5.

Figure 2:
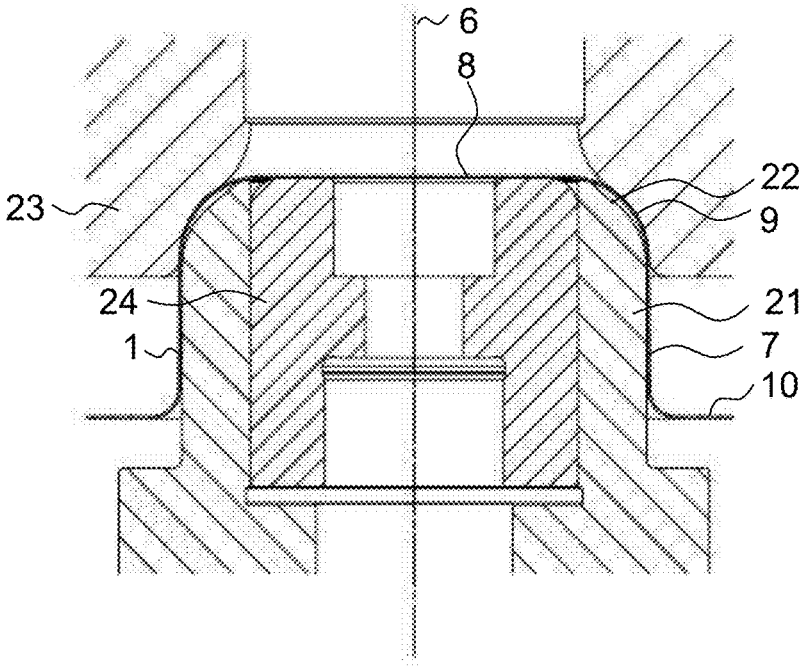
FIG. 2 shows the starting position for the intermediate drawing operation in the tool for the aerosol dome.

According to the illustration in FIG. 2, in the tool for the intermediate drawing operation or step-forming drawing operation, the blank 1 is guided by a punch into a drawing die 23. The drawing die 23 forms the external contour of the stepped region 11. The punch is formed in two parts. An annular blank holder 21 is arranged in an encircling external region. A cylindrical drawing punch 24 is movably mounted in said blank holder 23. At the start of this step-forming drawing operation, the front edge of the drawing punch 24 lies substantially flush with the front edge of the blank holder 21, and these lie with the front edge or plane substantially on the base portion 8 of the blank 1.

Figure 3:
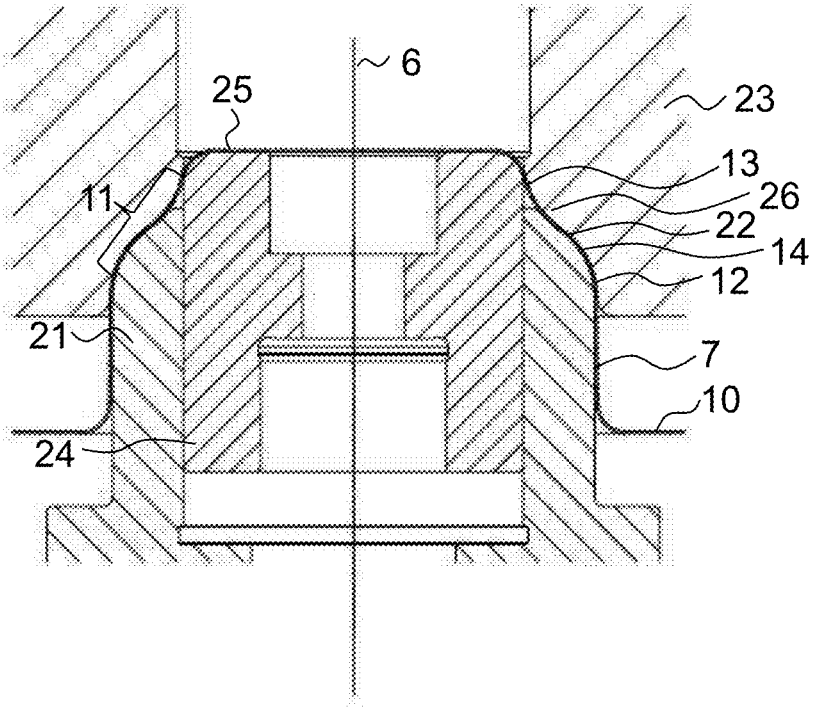
FIG. 3 shows the end position of the intermediate drawing operation in the tool for the aerosol dome.

Then, as can be seen from FIG. 3, the blank holder 21 moves all the way into the corresponding mating contour of the drawing die 23, such that the contact surface 22 of the blank holder 21 clamps the curved portion 9. After or at the same time as this, the drawing punch 24 moves further along the axis of symmetry 6 toward the base, and the substantially axial external contour of the drawing punch 24 then shapes the second cylinder portion 13 of the stepped portion 11, whilst the first cylinder portion 12 is clamped or at least guided between blank holder 21 and drawing die 23. A controlled taper to the newly formed base region 25 with a smaller radius than the original base region 8 is thus created, with cylindrical drawing being possible.

In other words, at the start of this step-forming drawing operation or at least in one phase of the step-forming drawing operation, the blank holder 21 lies against the part, and therefore no creases can form during the deformation. The drawing operation is, in principle, cylindrical. In the end position of the step-forming drawing operation, the metal sheet is fully held. The extent of the intermediate drawing operation or step-forming drawing operation may be adjusted as required. The extent of the intermediate drawing operation/step-forming drawing operation may be adapted to the geometry of the subsequent cone-forming drawing operation.

Figure 4:
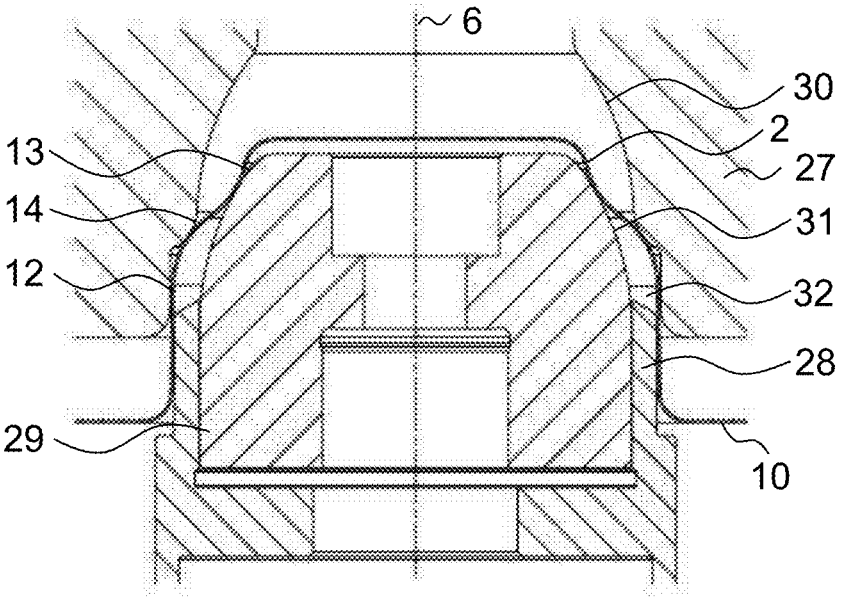
FIG. 4 shows the starting position for the first drawing operation in the case of the aerosol dome.

The tool for the subsequent cone-forming drawing operation is illustrated in FIG. 4 in the position in which the deformation process on the still-stepped component 2 is just commencing. Here, there is a drawing die 27 and a radially external annular blank holder 28 for the cone-forming drawing operation, and a drawing punch 29 for the cone-forming drawing operation is in turn movably mounted in said blank holder.

At the commencement of the formation of the conical region, the cylindrical first portion 12 is already guided or even clamped between the centering sleeve 28 and the corresponding mating contour, of cylindrical form, of the drawing die. The centering sleeve 28, and in parallel with this the drawing punch 29 for the cone-forming drawing operation, then move into the drawing die, wherein, at the same time, the first cylinder portion 12 is guided and partially deformed, and in particular the transition portion 14 and the second cylinder portion 13 are deformed by the conical contact surface 31 of the drawing punch 29.

Figure 5:
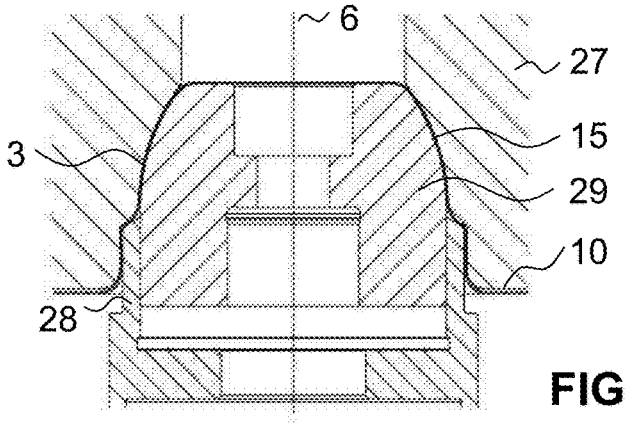
FIG. 5 shows the end position for the first drawing operation in the case of the aerosol dome.

The drawing punch subsequently moves yet further than the centering sleeve 28 into the drawing die 27, until the conical contact surface 30 is reached, that is to say the conical region 15 is deformed between the surfaces 30 and 31, as can be seen in FIG. 5.

Owing to the two radii at the start of this cone-forming drawing operation, the component is inherently more resistant to creasing. The free border is reduced in size owing to the two contact points between drawing die and drawing punch. In the end position, the component has, at least in the case of adequately thick materials, been deformed without creasing, and is ready for the second drawing operation.

FIGS. 6-8 illustrate the various tools for the corresponding implementation of the method, based on the example of the production of a coffee capsule, for example from polyester-lacquered sheet aluminum of type 8011A with a thickness of 0.1 mm. The weight per unit area of the aluminum is approximately 270 g/m$^2$, and that of the lacquer (including primer) is approximately 18 g/m$^2$.

Figure 11:
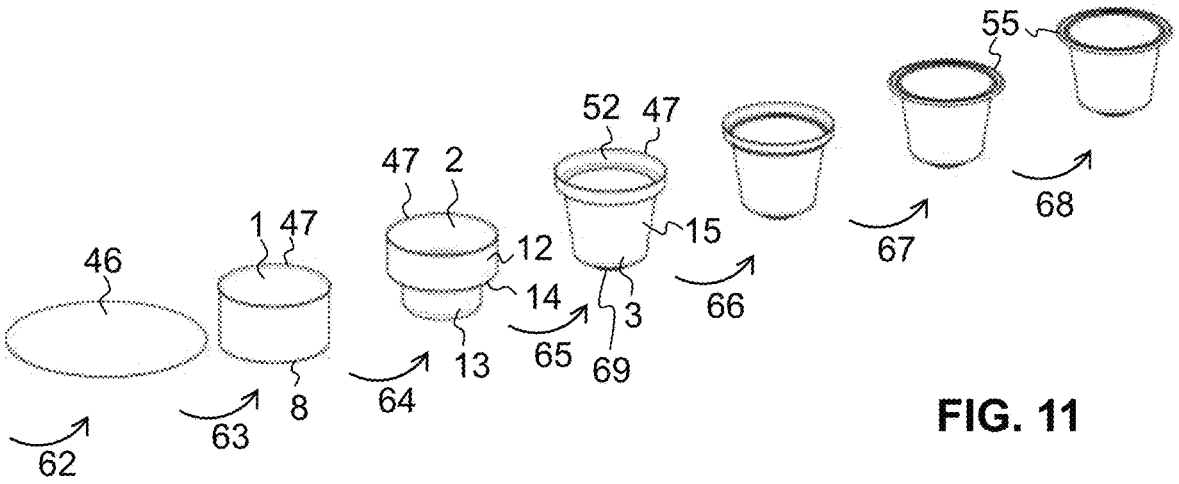
FIG. 11 shows the individual processing steps during the production of a coffee capsule.

The complete process of producing the coffee capsule (sequence of steps) is illustrated in FIG. 11, and will accordingly be described first in order to provide better understanding of the deformation steps.

In a cutting drawing operation 63, a pot-shaped blank 1 is deformed in a combined sequential stamping and deformation operation in one tool. It is also possible for only the planar stamped piece to be stamped out in a purely stamping step 62 in a first tool, and to then be deformed in a subsequent tool to form the blank 1. The pot-shaped blank 1 has a closed base portion 8 and an opening, and the wall 8 of the blank is cylindrical, that is to say extends encirclingly axially. In this step, at the same time, a slightly folded-over rim 47 is formed at the free upper edge in the manner of a conical flare at an angle of at most 20° with respect to the axial direction in order to provide stability for subsequent transport and in preparation for the rolling of the rolled rim.

This blank 1 is subsequently deformed in an intermediate drawing operation or step-forming drawing operation 64 to form the stepped component 2. Said stepped component still has the folded-over rim 47 at the free edge, and has a first cylinder portion 12 with the same radius as the original radius of the blank 1, which first cylinder portion however transitions, approximately at the midpoint of the height, into a second cylinder portion 13 of smaller radius via a transition portion 14.

Said stepped component 2 is deformed in a cone-forming drawing operation 65 to form the component 3 having a linearly conical portion. Here, a cylindrical rim region 52 remains, which has substantially the same radius as the original first cylinder portion 12. Said cylindrical rim region transitions via a radial flange into the main conical region 15 of the component 3. The base is likewise formed, with a second cone angle, in a further conical region 69. Both conical regions are formed in this cone-forming drawing operation.

In a subsequent step, in a groove-forming drawing operation 66, the encircling flange at the top is deformed further, as will be discussed in detail further below.

This is followed by a step in which the still axially upwardly projecting rim is rolled, to form a rolled rim 55, in a rim rolling operation 67.

This is followed by an embossing step 68 in which further structures, such as labeling or special structural features of wall portions such as decorative grooves or the like, can be embossed.

The tool for a combined stamping and deformation step for producing the blank 1 from a supplied metal sheet is illustrated in FIG. 6.

Figure 6A:
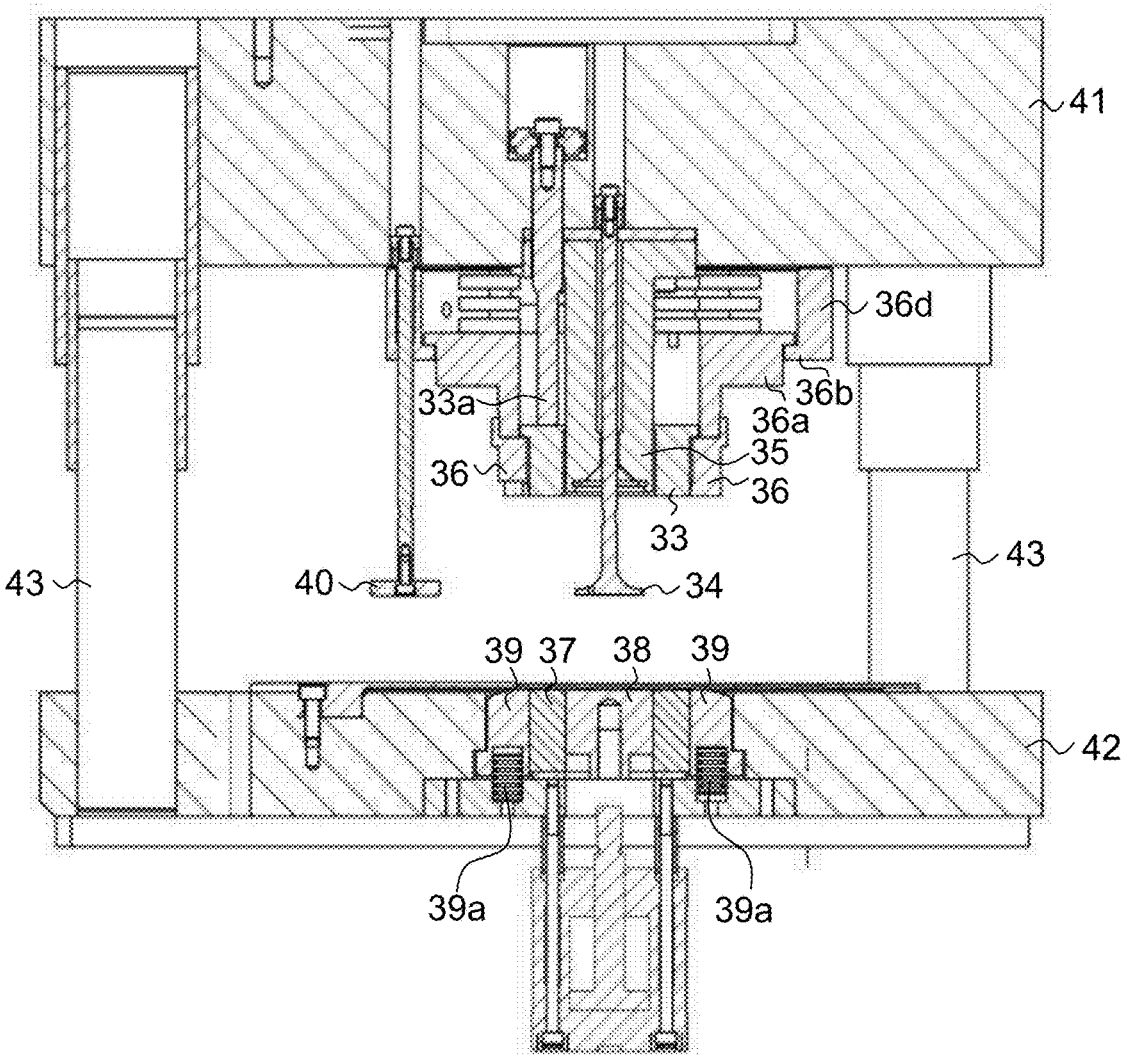
FIG. 6*a*-FIG. 6*c* shows a) a combined stamping and deformation station for stamping the stamped pieces and for deforming the same in the cutting drawing operation to form the blank of a coffee capsule in the opened state (TDC); b) shows the tool according to FIG. 6*a*) in the position in which the metal sheet is being stamped; and c) shows the tool according to FIG. 6*a*) in the closed state (BDC) when the blank has been deep-drawn.

The tool is designed as a transfer station having an upper carrier plate 41 and a lower carrier plate 42; the plates are guided by means of guide cylinders 23 and can be moved relative to one another only in a vertical direction. FIG. 6*a* shows the top dead center (TDC) of the tool. The deformation steps are each performed with the opening of the component directed upward. The strip is supplied as a sheet-metal strip and is held by means of a hold-down pin 40 and the further hold-down pin 34 that is centered in the tool.

The drawing punch 35 for the drawing operation, and the associated blank holder 33, which radially surrounds the drawing punch, are provided on the upper carrier plate. Said blank holder 33 is however in turn also surrounded by a cutting ring 36 or a cutting die, which has the task of providing the circular planar stamped piece before the deep-drawing process. Said cutting die 36 is supported by a support element 36*a*, which at the top dead center lies against a stop 36*b* of the corresponding guide 36*d*. The cutting ring 36 and blank holder 33 are axially movable relative to one another to a small extent.

Figure 6B:
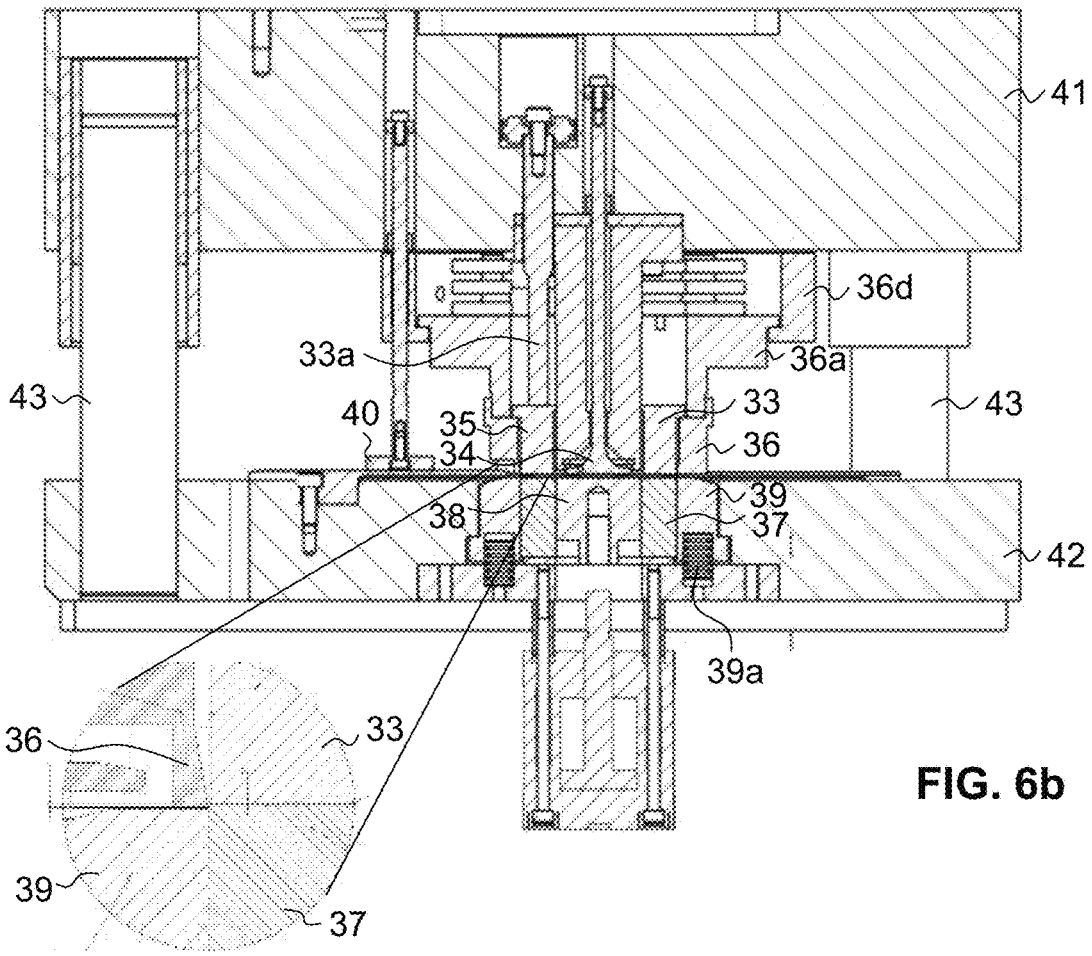

Radially at the outside on the lower carrier plate 42, there is firstly a lifter 39 that is braced upward by means of a spring mounting 39. Following this radially to the inside is the annular cutting punch 37 for the cutting drawing operation, said annular cutting punch simultaneously being the deep-drawing die for the drawing operation for forming the blank. This is then followed, in the very center, by the ejector 38 for the cutting drawing operation. FIG. 6*b* illustrates the position in which the circular stamped piece 46 has just been stamped out of the sheet-metal strip. The upper carrier plate 41 moves downward, the cutting punch 37 is fixed in its position, but the lifter 39 can be pushed downward slightly owing to the spring mounting 39*a*. The front surfaces of blank holder 33 and cutting die 36 then abut against the surface of the metal sheet, with the cutting die 36 being fixed by abutment against the support element 36*a*, whereas the blank holder 33 can deflect upward slightly. As can be seen in the enlarged view at the bottom left in FIG. 6*b*, the cutting ring 36 thus plunges somewhat further downward, the blank holder 33 and cutting punch 37 clamp the metal sheet, and the inner ring edge of the cutting ring 36 stamps the metal sheet by plunging downward around the rim contour of the cutting punch 37.

Figure 6C:
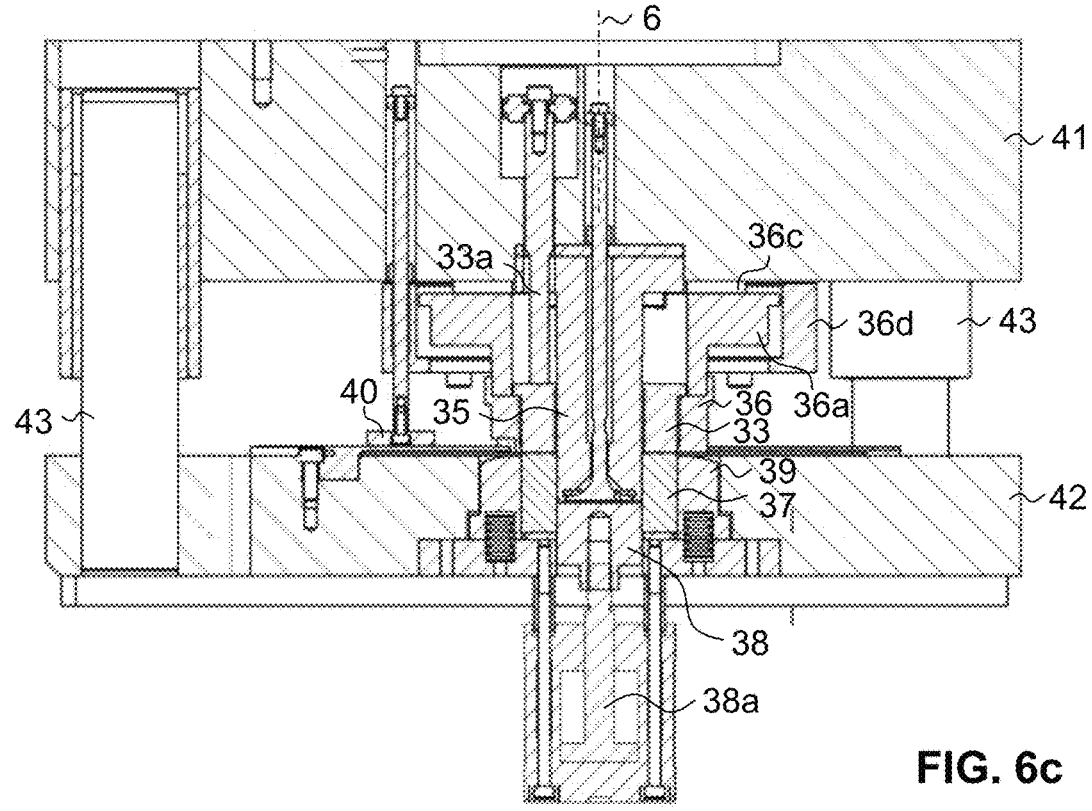

This is not followed by transfer to a subsequent station; instead, the stamped piece 46 that is thus held between blank holder 33 and cutting punch 37 is deformed directly in the same station to form the blank 1 by virtue of the tool moving yet further downward as far as the bottom dead center (BDC), which is illustrated in FIG. 6*c*. The drawing punch 35 then moves into the annular recess in the cutting punch 37, with the ejector 38 being pushed downward by means of the drawing punch 35. The base is pressed against the drawing punch 35 at all times by means of the pneumatic cylinder 38*a*. The cylindrical wall 7 of the blank 1 is thus formed between the drawing punch 35 and the cutting punch or deep-drawing die 37. At the same time, the upper encircling internal edge of the deep-drawing die 37 is convexly curved, and the extent of the drawing operation is set such that the aforementioned slightly outwardly folded-over rim section 47, that is to say a short flange that flares in trumpet-shaped form, so to speak, is formed on the blank 1 for the purposes of stabilizing the blank 1 at the upper edge.

Said blank 1 is then transported by means of a transfer installation to the next station, which then performs the step-forming drawing operation 64; the corresponding tool is illustrated in FIG. 7.

Figure 7A:
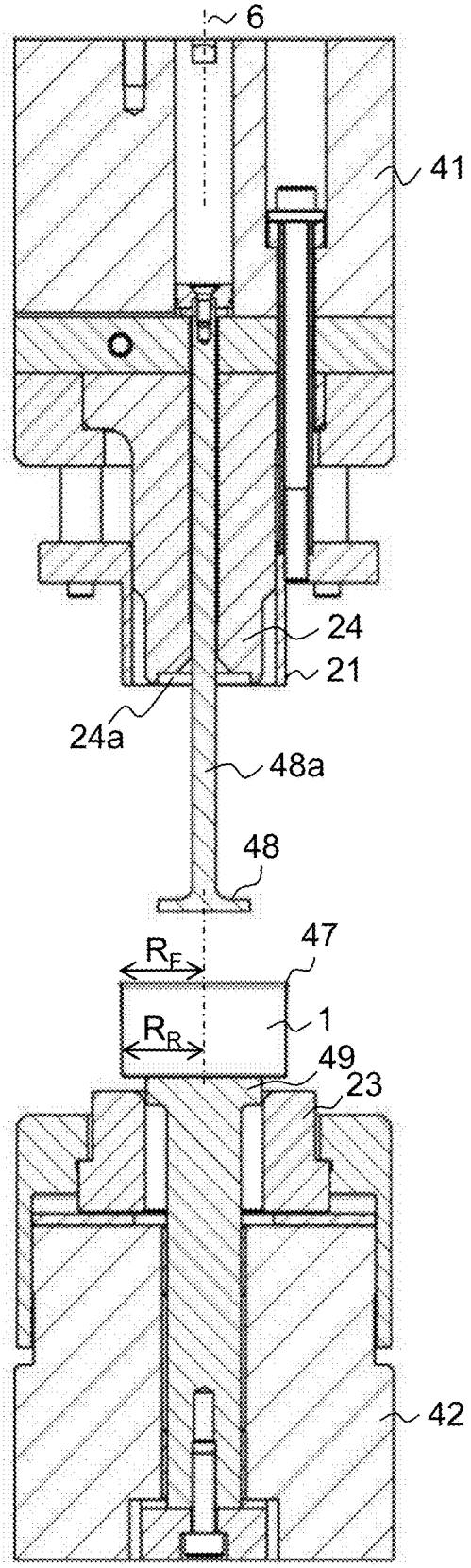
FIG. 7*a*-FIG. 7*b* shows a) the tool for the intermediate drawing operation during the production of the coffee capsule in the open state (TDC); b) shows the tool for the intermediate drawing operation during the production of the coffee capsule in the closed state (BDC)
Figure 7B:
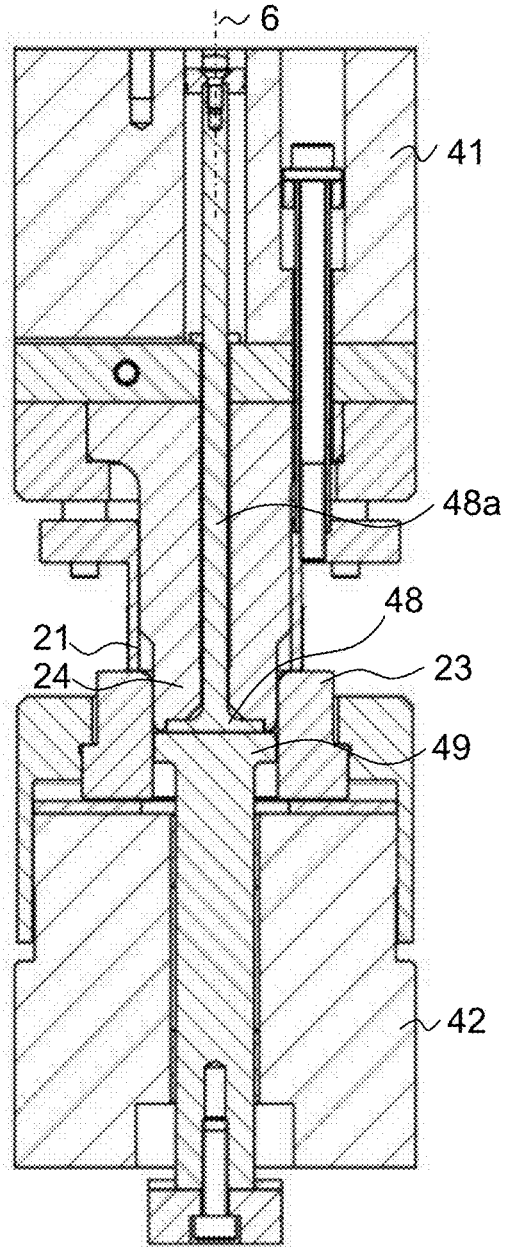

Here, an upper carrier plate 41 and a lower carrier plate 42 are again provided. The blank holder 21 for the step-forming drawing operation is provided on the upper carrier plate, and the drawing punch 24 is mounted axially movably in said blank holder. A hold-down pin 48 is additionally provided in a central recess of said drawing punch, which hold-down pin is mounted with its guide pin 48*a* axially movably in said central recess. The front surface of the drawing punch 24 has a concave front surface contour 24*a*, which corresponds to the rear-side convex contour of the hold-down pin in the foremost region of extent, such that, when the hold-down pin 48 is situated in the fully retracted position in the drawing punch 24, said two elements jointly form a flush, radially extending front surface (see FIG. 7*b*). The lower drawing die 23 is provided, as an annular element, axially immovably on the lower carrier plate 42. The ejector 49 is provided axially movably in said drawing die 23. FIG. 7*a* illustrates the tool for the step-forming drawing operation at top dead center. The blank 1, which has been transported to this station by means of a transfer apparatus, now lies as a blank 1 on the ejector 49, and the upper tool part moves downward. Here, the blank 1 is firstly clamped between the ejector 49 and the front surface of the hold-down pin 48. The blank holder 21 then moves, initially without a deforming action, into the upper recess of the blank, which is made easier by the slight flare 47. At a suitable point in time for the desired extent of the drawing operation for the first and the second drawing segment, the drawing punch 24 then also begins to move further downward beyond the front edge of the blank holder 21, and the stepped region is formed by virtue of the radial circumferential surface in the front region of the blank holder 21 guiding the blank, the transition portion 14 being formed at the upper rim edge of the drawing die, and the second cylinder portion being formed by the radial external surface of the drawing punch and the radial internal surface of the drawing die. FIG. 7*b* illustrates the tool for the step-forming drawing operation when bottom dead center has been reached.

Figure 8A:
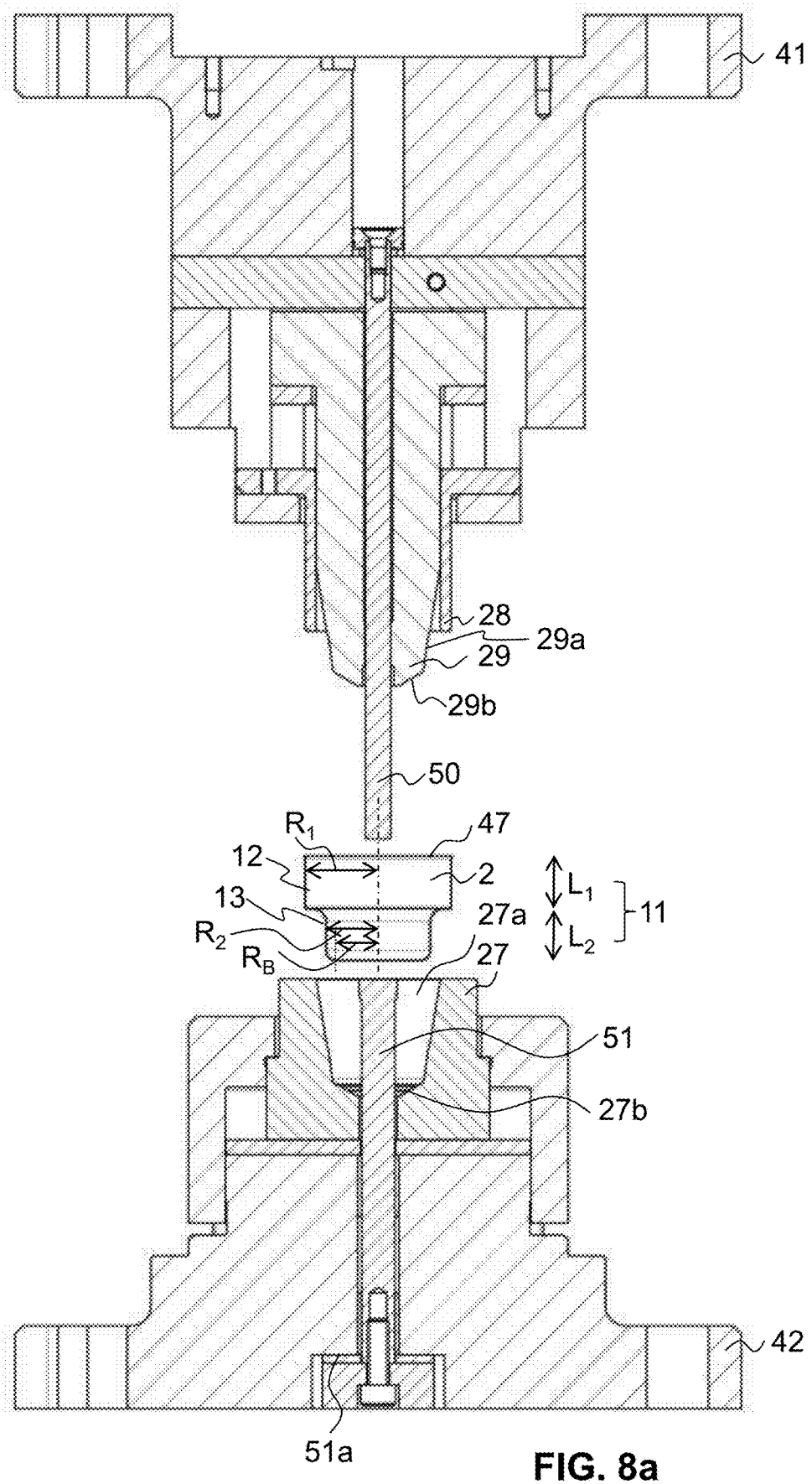
FIG. 8*a*-FIG. 8*c* shows a) the tool for the cone-forming drawing operation during the production of the coffee capsule in the open state (TDC); b) shows the tool for the cone-forming drawing operation according to FIG. 8*a*) in the semi-closed state; and c) shows the tool according to FIG. 8*a*) in the closed state (BDC)

The cone-forming drawing operation 65 that then follows is performed in the tool illustrated in FIG. 8. FIG. 8*a* illustrates the tool for the cone-forming drawing operation at top dead center. Here, on the upper carrier plate, there is again a blank holder 28 of annular form, the position of which is not fixed relative to the upper carrier plate but is axially movable. The drawing punch 29 for the cone-forming drawing operation is formed in said blank holder 28 and has a doubly conical external contour, namely the main first cone 29*a* for the main conical region, and a further cone 29*b* for the conical form of a base region 69. In said drawing punch 29, in turn, there is provided an axially centered hold-down pin 15 that is mounted axially movably in the drawing punch.

Provided on the lower carrier plate is the annular drawing die 27, which forms the mating contour, so to speak, for the external surface of the drawing punch 29. The mating surface for the second cone 29*b* is provided by the lower cone surface 27*b*, and the mating surface for forming the main conical region by means of the surface 29*a* of the drawing punch is provided by the region 27*a* of the drawing die.

Provided movably in said drawing die 27, in turn, is an ejector 51 which, exactly as in the case of the tool according to FIG. 7, also serves inter alia for pushing the finished component out of the tool from below, and making it accessible for the gripper of the transfer system, when the upper plate is pushed upward again.

The component after the step-forming drawing operation 2 is then clamped between the hold-down pin 50 and the ejector as soon as said component has been moved by the transfer installation to the position of this station, and the upper tool part is then lowered further downward.

Figure 8B:
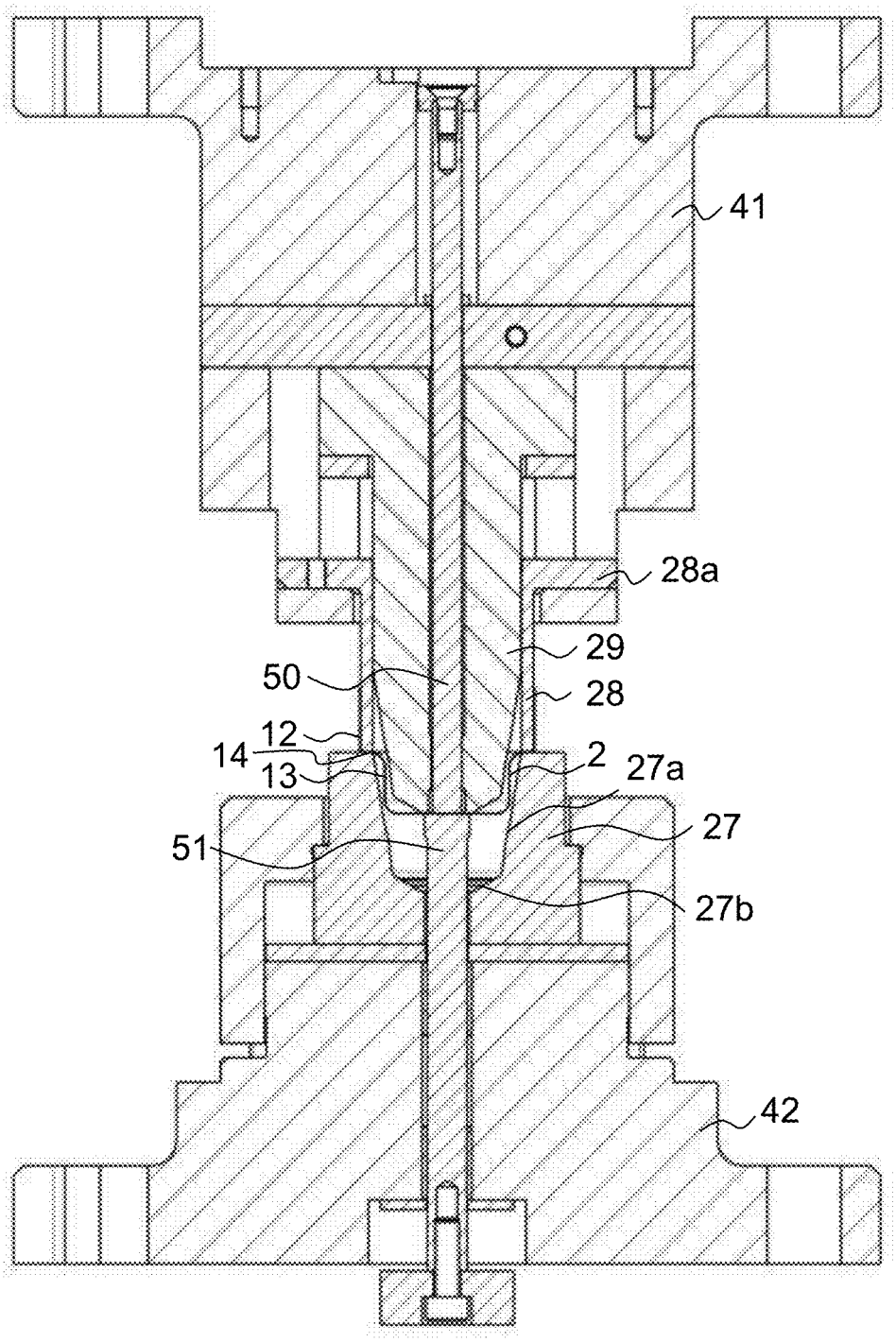
Figure 8C:
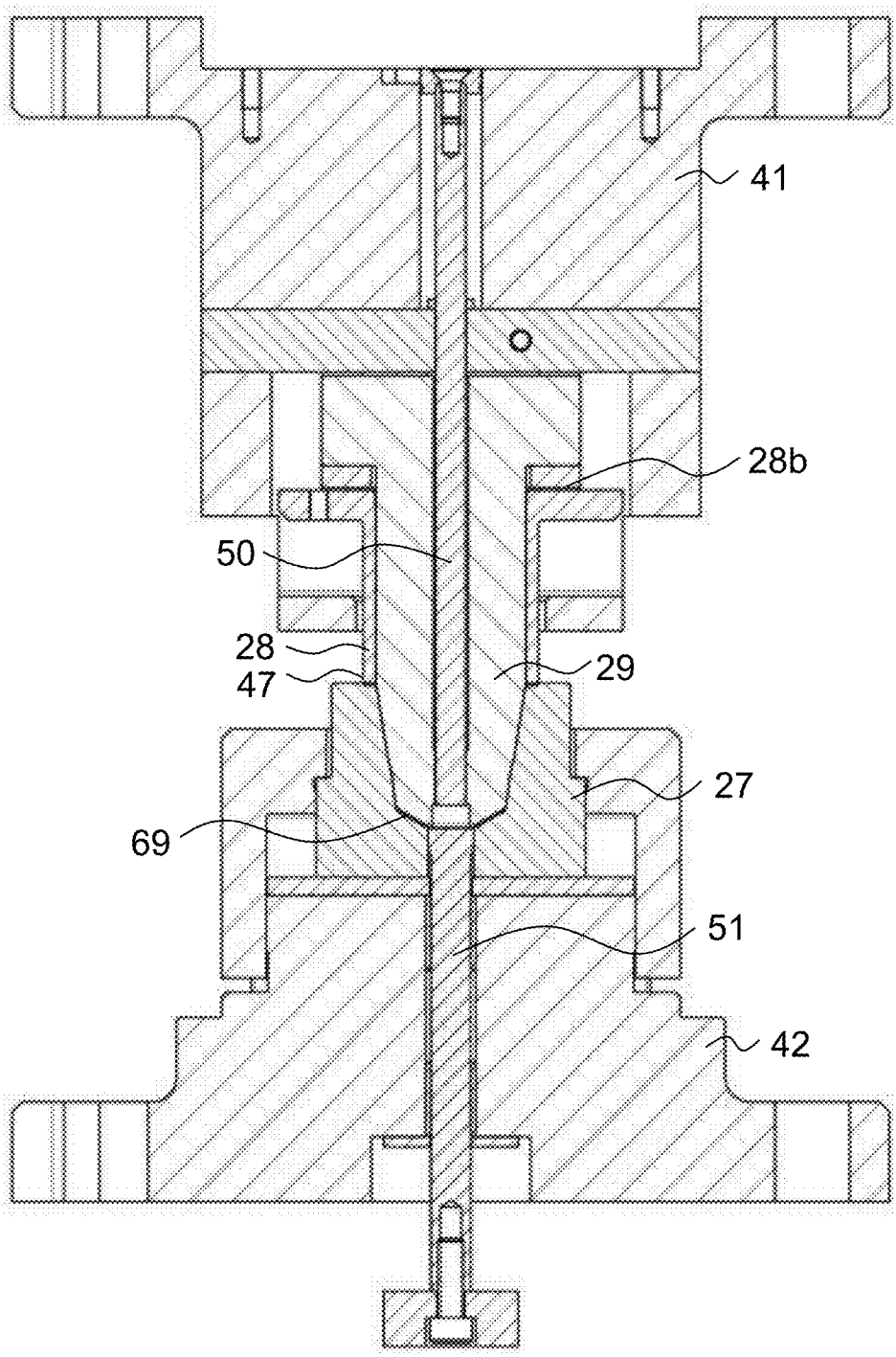

FIG. 8*b* illustrates the position in which the actual deformation process on the component 2 is just commencing. The blank holder 28 has already moved into the first cylindrical portion 12 of the component 2, and the drawing punch 29 has, with its foremost surface, so to speak, been pushed downward onto the base of the component 2. The actual deformation process then commences when the tool is closed further and the drawing punch plunges further into the drawing die 27. Here, the transition region 14 and the second cylinder portion 13 are firstly deformed, and the second cylinder portion 12 is then drawn further downward into the mold, so to speak, until only a cylindrical rim region 52 is held by the external contour of the blank holder in the fully closed position, as illustrated in FIG. 8*c*.

The contours of drawing punch 29 and drawing die 27 then lie fully against one other, and, in particular, the further conical region 69 has also been formed in the base region.

This component 3 is then subjected to the operations already described further above in conjunction with FIG. 11; the tools for these will no longer be illustrated in full.

Figure 9:
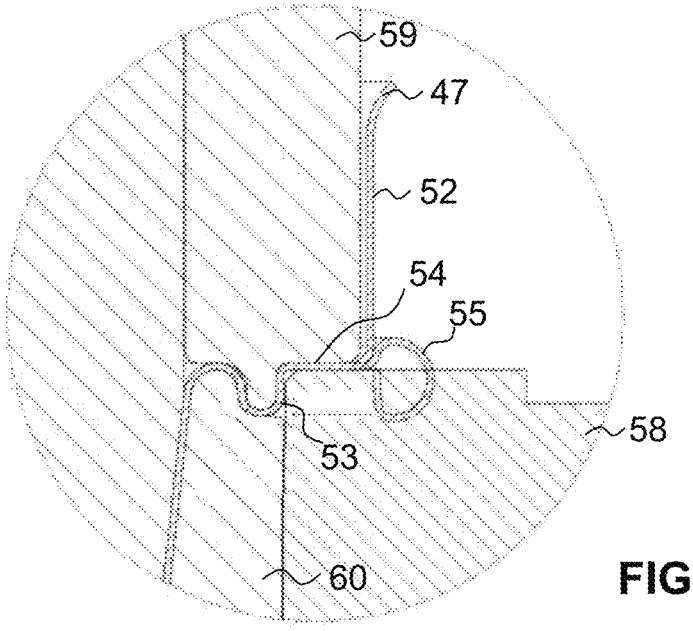
FIG. 9 shows a detail from the rim region of the coffee capsule in the tool after the groove-forming drawing operation, with a rolled rim additionally being schematically indicated.

FIG. 9 shows only the flange region in the transfer tool for the groove-forming drawing operation 66. The encircling bead 53 is formed in this tool by a shaped piece 59 from above, which shaped piece plunges into a die 58 having an internal shaped piece 60. In this step, the cylindrical rim region 52 and also the folded-over rim 47 initially remain.

Figure 10:
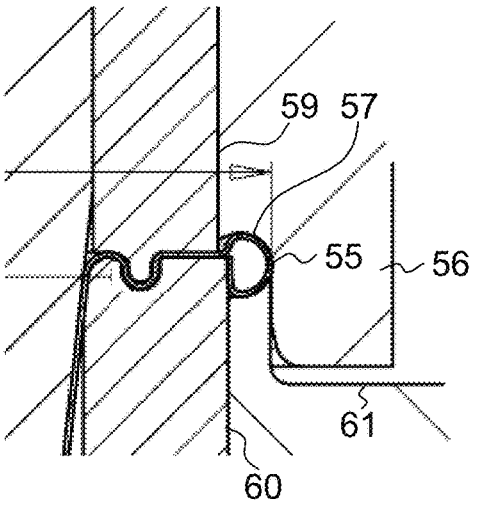
FIG. 10 shows a detail from the rim region of the coffee capsule in the tool after the completion of the rolling of the rim.

The rolled rim 55 illustrated in FIG. 9 is to be understood merely diagrammatically, and is first formed in the next tool or in a subsequent step in the same tool in the rim rolling operation 67, as illustrated in FIG. 10. A rolling punch 56 having a correspondingly formed rolling contour 57 moves downward from above along a shaped piece 56, can optimally commence the rolling process owing to the already slightly flared upper contour 47, and folds the rolled rim 55 over to form a completely closed rim.

It is thus possible for coffee capsules to be produced in one or more steps, and with or without a sealing groove. The material thickness used ranges here from 90 my (micrometers) to 120 my. As described, in this method, the rolled rim is fully shaped, without preparation, in the rolling station. When processing relatively thin aluminum foils of 50 my to 80 my, the rolled rim can no longer be produced in the manner described above because the yet thinner material buckles in the rim rolling station, and an acceptable result thus cannot be achieved. Also, the creasing that occurs during the finishing drawing operation is of such magnitude that it can result in side wall cracks and thus unsealed capsules.

In order to form the rolled rim without damage (buckling), preparation for the rolling operation is then necessary. In the sequence of steps, in the first station, a residual flange in the form of the aforementioned conical flare 47 remains on the part.

Before the rolling station, this residual flange or the conical flare 47 is form-fittingly formed through approximately 120° as illustrated in FIG. 12.

In this figure, the rim region 47 such as is typically produced during the cutting drawing operation 63 for the purposes of stabilizing the upper free edge is illustrated in a). Typically, this rim region for stabilizing the upper edge is folded over, in the processing steps, through at most 90° with respect to the axial direction (as viewed in the opening direction of the container), and has, for example for the stated thin material with a thickness in the range from 0.05-0.08 mm of coated aluminum, a substantially planar radial flange with a width RA in the range from 1-1.5 mm.

In the tool illustrated in b) for the groove-forming drawing operation, said conical flare 47 is then deformed (or rolled) to form a folded-over flare 74 by virtue of the conical flare being guided form-fittingly between a die 58 and a folding punch 70. Here, the original maximum angle of 90° with respect to the axial direction is folded over, at least in the outermost radial rim region, to more than 90°, typically to 100-120°.

The folded-over flare 74 is subsequently deformed in the rim rolling operation 67 to form the definitive flange as illustrated in c).

By means of these measures, the rolling operation in the rolling station can be performed with a lower initial force, and buckling can be prevented.

To prevent side wall cracks, a further intermediate drawing operation is used, in addition to the existing step-forming drawing operation, to prepare for the finishing drawing operation (cone-forming drawing operation).

The intermediate drawing operations (further intermediate drawing operation and step-forming drawing operation) are adjustable in terms of their extent in order that the volumes can be distributed such that, at the start of the cone-forming drawing operation, the part is as far as possible in contact with the drawing die and the drawing punch, as illustrated in FIG. 13.

Here, the component 2' after the further intermediate drawing operation 71 is illustrated in a). From top to bottom, it is possible to see the folded-over rim 47 or the conical flare, the adjoining first cylinder portion 12, the transition portion 14, and the following second cylinder portion 13. Said second cylinder portion is then followed by a further cone portion 73, which may however also have an axial portion, with a base 82' which then has a smaller diameter than the base of the component 2 after the step-forming drawing operation.

If, as illustrated in b), the drawing punch 29 for the cone-forming drawing operation then moves into said component 2' after the further cone-forming drawing operation, the surface of the drawing punch 29 makes contact with the component at a large number of contact points 75, allowing significantly improved guidance and prevention of side wall cracks. As can be seen from the drawing punch that has plunged in further in c), said guidance is provided throughout the further drawing operation, and ultimately leads to the closed tool as per d).

FIG. 14 illustrates the sequence of steps with the further elements for the processing of relatively thin aluminum sheets.

The blank 1 having the folded-over rim 47 is produced analogously to the illustrations above, optionally with a rim of relatively large width and a fold angle of up to 90° (angle between the axis of symmetry in the opening direction of the component and the radially outermost portion of the rim 47).

This component is deformed in the step-forming drawing operation 64 to form the component 2, likewise as discussed above.

Then, in a departure from the sequence of steps illustrated in FIG. 11, a further intermediate drawing operation 71 is performed, in which a further cone portion 73 is formed from the base 25, ultimately resulting in a base 82' with a smaller radius than the base 25.

This is followed by the cone-forming drawing operation 65 as described above.

This is then followed by a groove-forming drawing operation 66, in which not only is the groove formed but also, as already described above, the folded-over rim 47 is folded over or rolled to form a folded-over flare 74 with a fold angle $\alpha$ of greater than 90°, in this case approximately 120°, with respect to the axial direction.

A rim rolling operation 67 subsequently takes place as described above.

The sequence may be followed by further embossing steps or the like.

The new sequence of steps thus includes the following innovations:

To make the rim rolling operation stable, the cutting drawing operation is configured such that a residual flange of approximately 1.5 mm remains. The cutting drawing operation itself remains the same, and may be differed in terms of the extent of the drawing operation. The blank holder 33 should be capable of being retracted by means of 33*a*.

Said residual flange is then form-fittingly angled in station 5. This method has, inter alia, three advantages.

1. The flange does not slip away from under the blank holder, and thus the risk of chip formation in the case of anisotropic materials is also much lower.
2. As a result of the form-fitting pre-pressing of the rolled rim in the station 5, the rolled rim is optimally rolled in the rolling station 6.
3. By means of this method, in the case of anisotropic material, the contact between the rolled rim and the rolling die occurs simultaneously around the circumference. As a result of the further intermediate drawing operation, the volumes are optimally prepared, and fewer creases that can then lead to side wall cracks are formed in the finishing drawing operation.

Figure 15A:
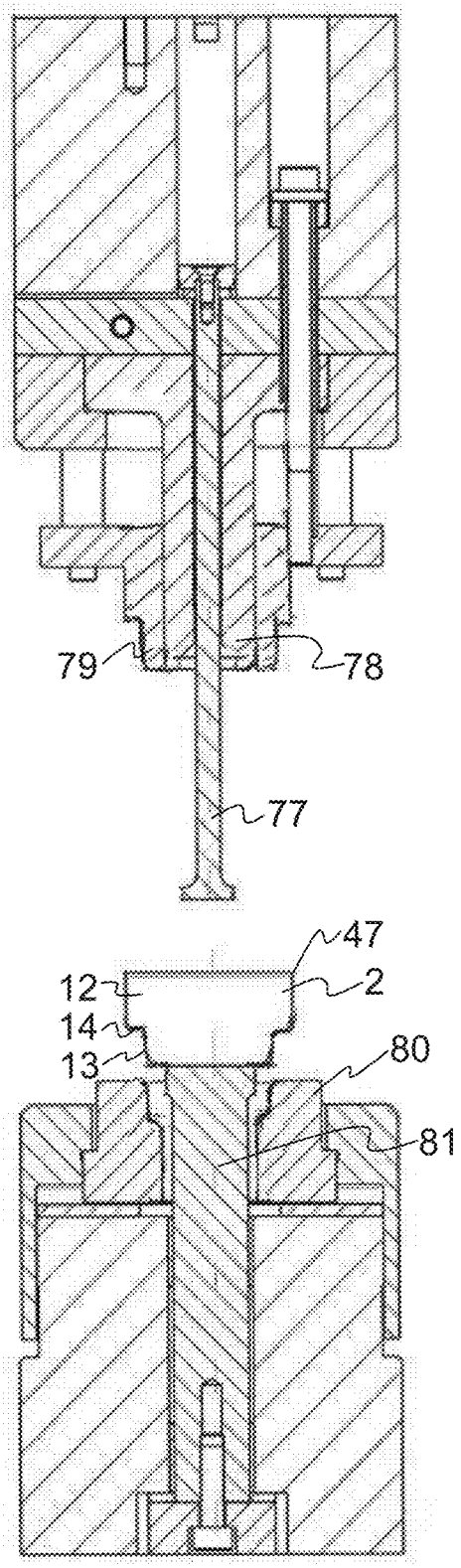
FIG. 15*a*-FIG. 15*b* shows, in a), the opened tool for the further intermediate drawing operation and, in b), the closed tool for the further intermediate drawing operation at bottom dead center.
Figure 15B:
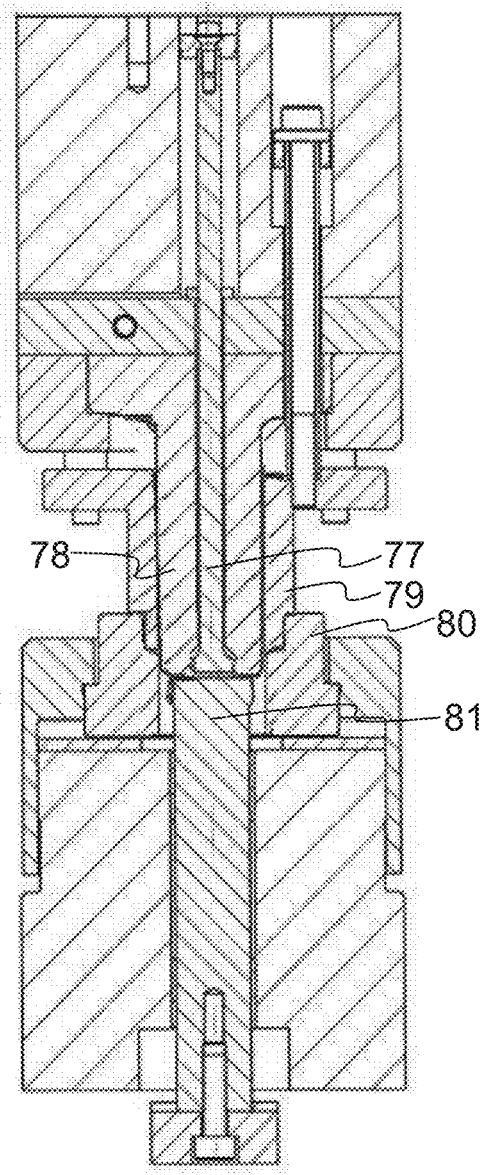

FIG. 15 shows, in a), the tool for the further intermediate drawing operation 71 in the open state. Here, the component 2 after the step-forming drawing operation is situated on the ejector 81, and is then held in the position by means of the hold-down pin 77. The drawing die 80 is arranged on the bottom side, and, at the top, around the hold-down pin 77, there is firstly the drawing punch 78 and, around this, the blank holder 79 which, as can be seen from the illustration of the closed tool in b), not only holds the processed component in the region of the transition portion 14 and of the second cylinder portion 13 but also controls said component at the new transition to the cone portion 73. The front contour of the drawing punch forms the cone portion 73 from the base 25.

Figure 16:
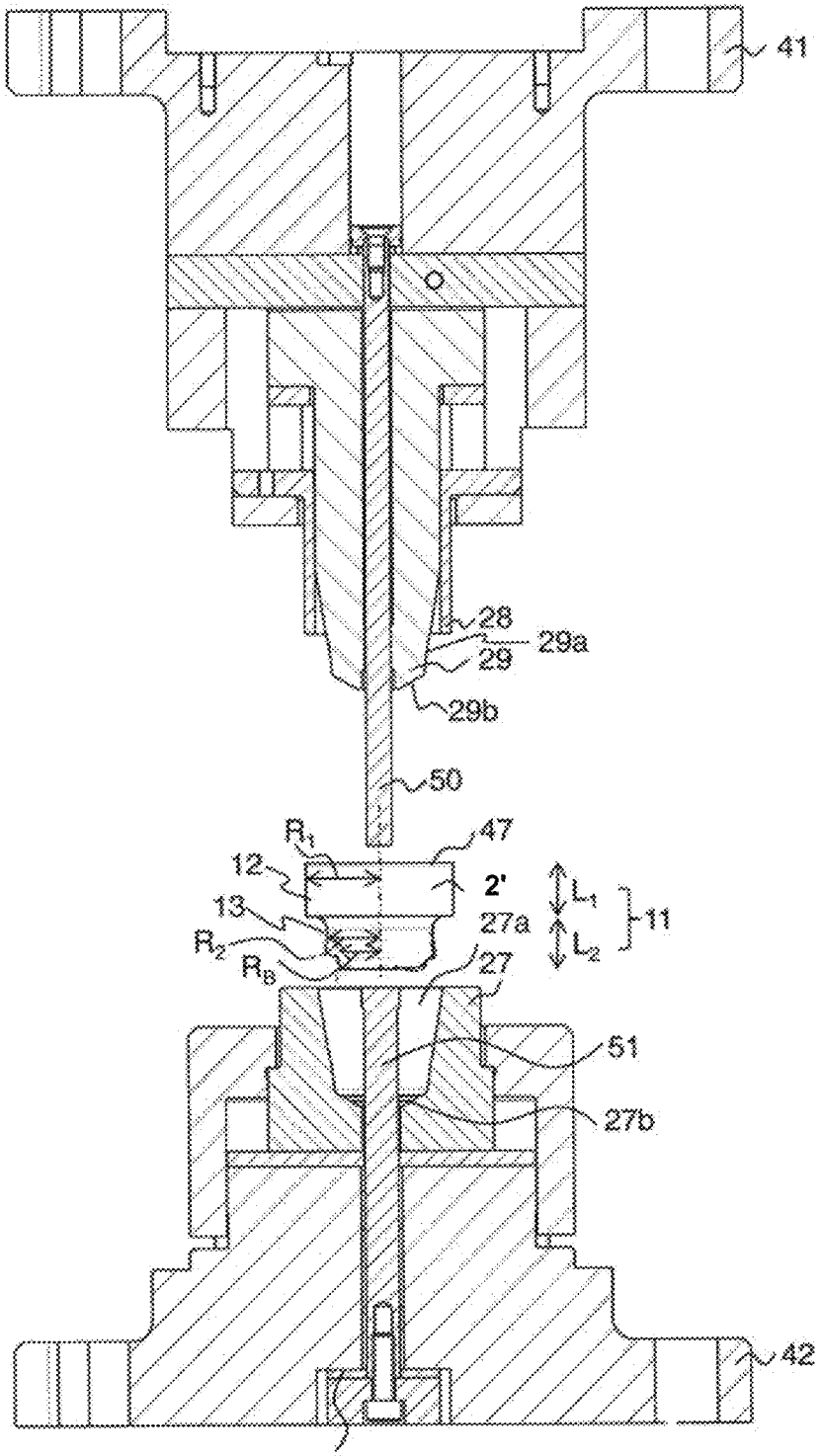
FIG. 16 shows the opened tool for the cone-forming drawing operation together with the component after the further intermediate drawing operation.
Figure 17:
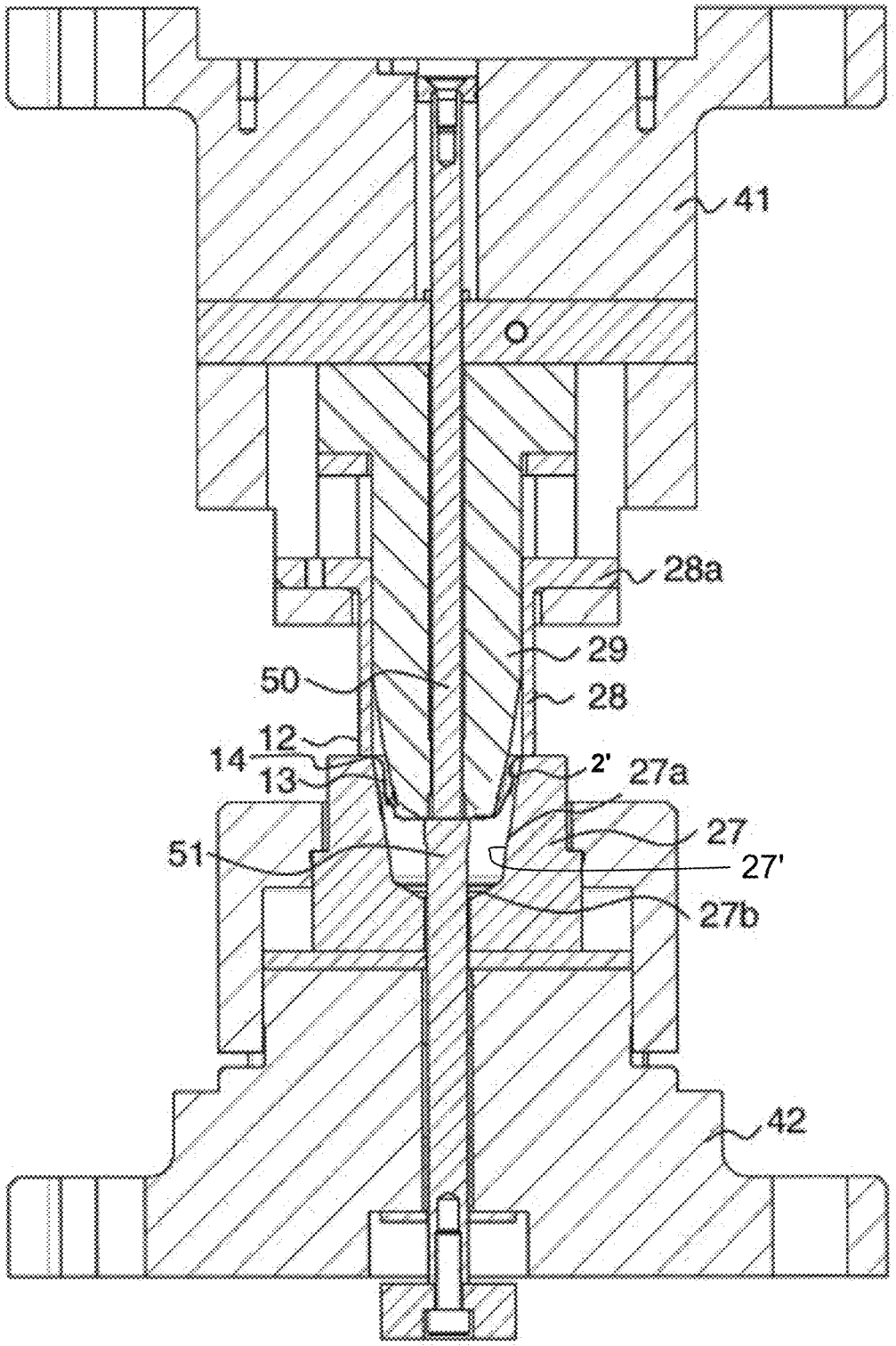
FIG. 17 shows the semi-closed tool for the cone-forming drawing operation together with the component after the further intermediate drawing operation.

FIG. 16 shows the open tool for the cone-forming drawing operation if the starting point is the component 2' after the further intermediate drawing operation and not, as illustrated in FIG. 8*a*, the component 2 after the step-forming drawing operation. In particular, the transition from this figure to FIG. 17, in which, analogously to FIG. 8*b*, the tool is illustrated in the semi-closed state for the cone-forming drawing operation, makes it clear how the further cone portion 73 allows improved contact between the drawing punch 29 and component and thus a more controlled process.

Figure 18:
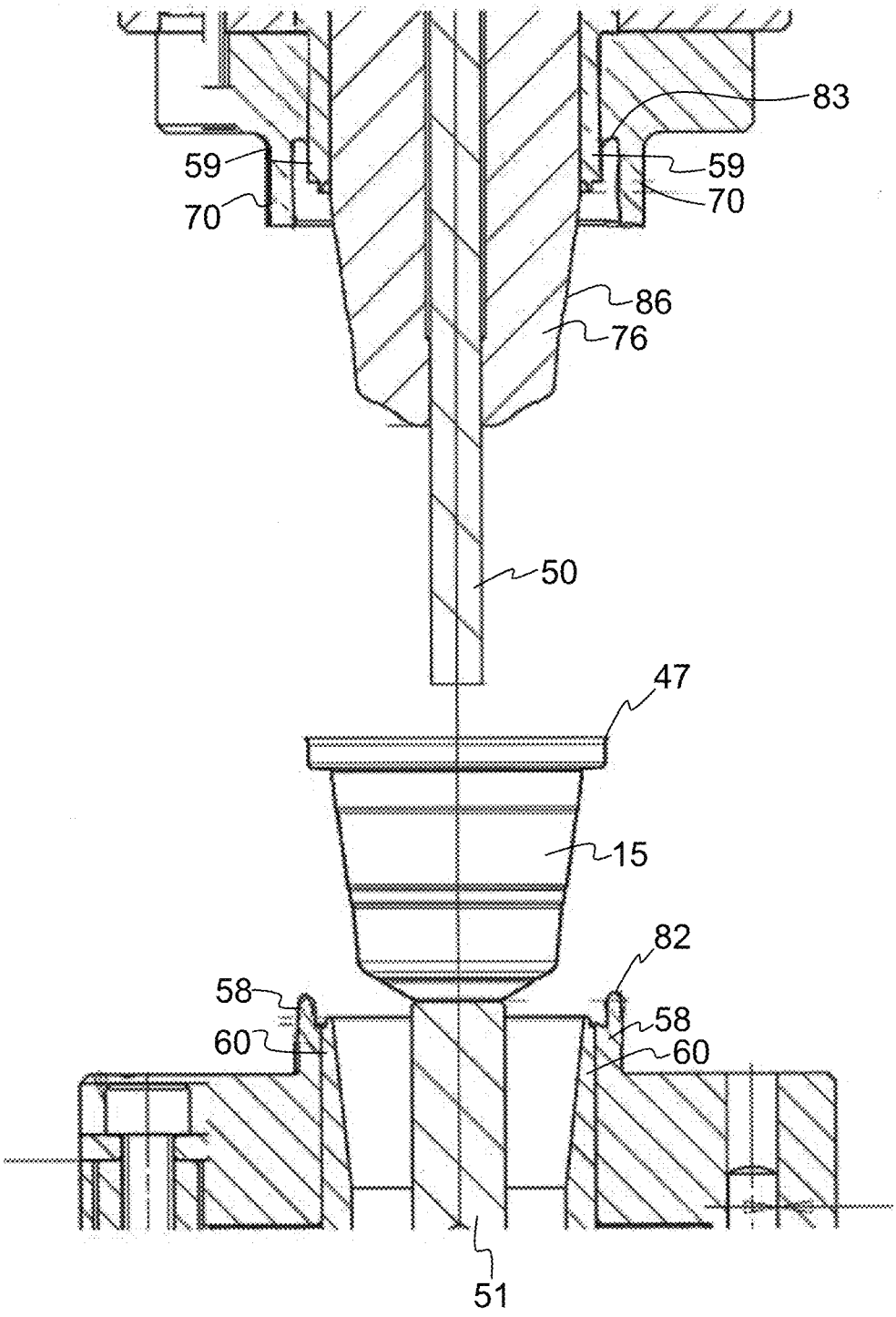
FIG. 18 shows the open tool for the groove-forming drawing operation for the production of the folded-over flare.

FIG. 18 shows the open tool for the groove-forming drawing operation 66 in which, in this case, however, not only is the groove 53 formed, but the folded-over rim 47 is also shaped or rolled to form a folded-over flare 74. For this purpose, there is a shaped piece 60 in the lower part of the tool, and around this there is a die 58, on the upper rim of which there is a shaped contour 82 which, in interaction with a corresponding internal contour 83 of the folding punch 70 that forms the upper tool part, allows the controlled formation of the folded-over flare 74. Radially on the inside of the folding punch 70, there is firstly the shaped piece 59 for forming the groove, and further to the inside, there is the holding punch 76, in the central bore of which the hold-down pin 50 is guided.

Figure 19:
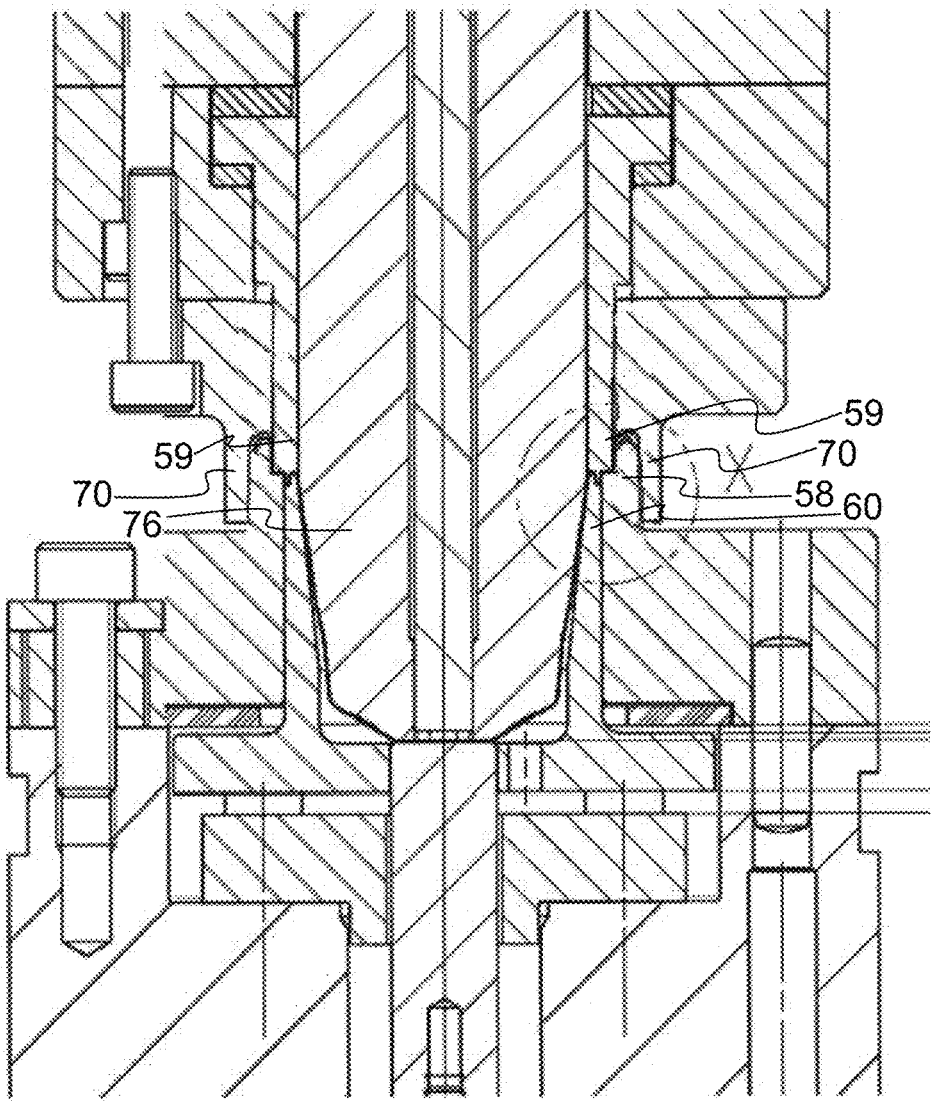
FIG. 19 shows the tool for the groove-forming drawing operation at bottom dead center.

If the tool is closed, this results in the position as illustrated in FIG. 19, in which, between the die 58 and folding punch 70, the folded-over rim 47 is rolled in controlled fashion to form the folded-over flare 74 by the two contours 82 and 83.

Figure 20:
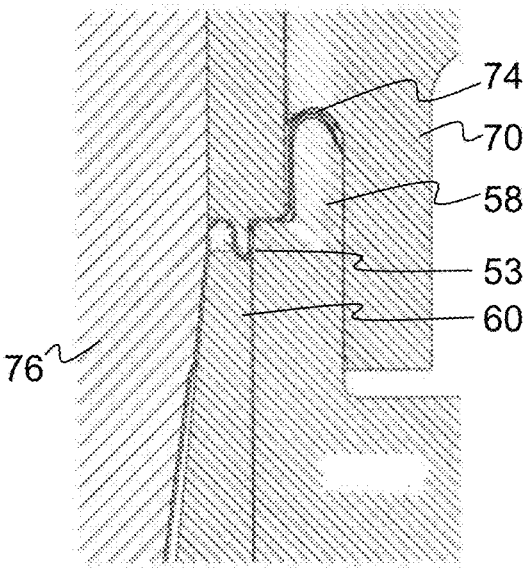
FIG. 20 shows the detail, circled in FIG. 19, of the rim flange in the tool.

This is illustrated in detail in FIG. 20 in a sectional illustration of the rim region in the tool for the groove-forming drawing operation.

Figure 21:
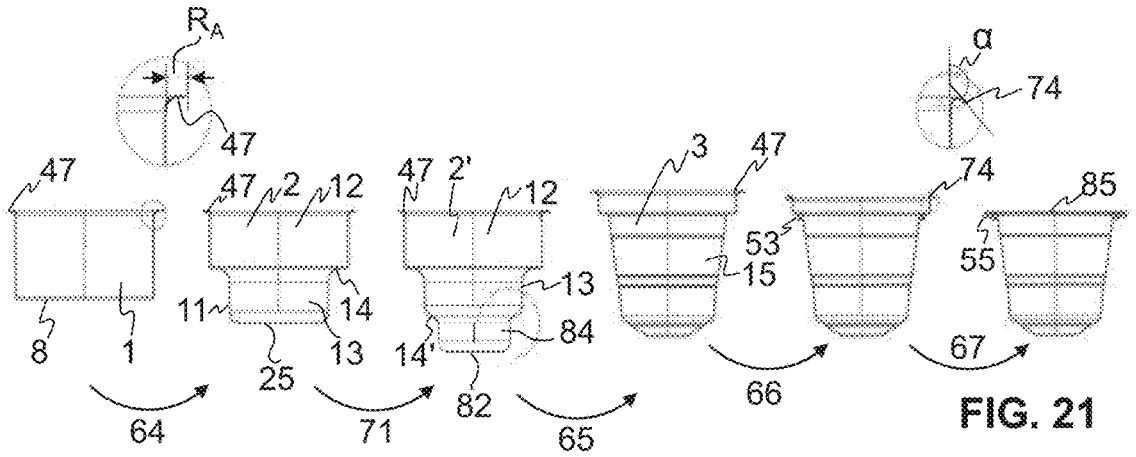
FIG. 21 shows the sequence of steps with the further intermediate drawing operation and the formation of the folded-over flare in the groove-forming drawing operation according to a further embodiment of the method.

FIG. 21 illustrates a further alternative sequence of steps with the further elements for the processing of relatively thin aluminum sheets.

The blank 1 having the folded-over rim 47 is produced analogously to the illustrations above, optionally with a rim of relatively large width and a fold angle of up to 90° (angle between the axis of symmetry in the opening direction of the component and the radially outermost portion of the rim 47).

This component 1 is deformed in the step-forming drawing operation 64 to form the component 2, likewise as discussed above.

Then, in a departure from the sequence of steps illustrated in FIG. 11 and in a departure from the sequence of steps illustrated in FIG. 14, a further intermediate drawing operation 71 that is modified in relation to FIG. 14 is performed, in which a further cylinder portion 84 with a radius $R_3$ is formed from the base 25, again ultimately resulting in a base 82' with a smaller radius than the base 25.

This is followed by the cone-forming drawing operation 65 as described above.

This is then followed by a groove-forming drawing operation 66, in which not only is the groove formed but also, as already described above, the folded-over rim 47 is folded over or rolled to form a folded-over flare 74 with a fold angle $\alpha$ of greater than 90°, in this case approximately 120°, with respect to the axial direction.

A rim rolling operation 67 subsequently takes place as described above.

The sequence may be followed by further embossing steps or the like.

The new sequence of steps thus includes the following innovations:

To make the rim rolling operation stable, the cutting drawing operation is configured such that a residual flange of approximately 1.5 mm remains. The cutting drawing operation itself remains the same, and may be differed in terms of the extent of the drawing operation. The blank holder 33 should be capable of being retracted by means of 33*a*.

Said residual flange is then form-fittingly angled in station 5.

FIG. 22 shows the main elements by which this variant differs from that presented in particular in conjunction with FIG. 14.

Figure 22A:
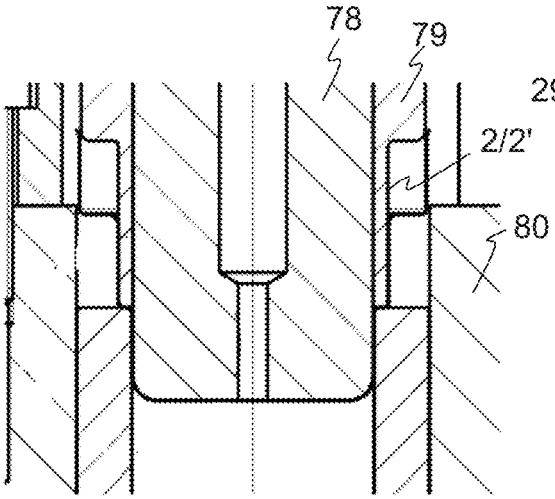
FIG. 22*a*-FIG. 22*b* shows, in a), a schematic axial section through the tool for step 71 according to the sequence of steps in FIG. 21, and in b), a schematic axial section through the tool for step 65 in FIG. 21.

FIG. 22*a* illustrates the tool in an axial section for the step 71 according to the sequence of steps in FIG. 21. The component 2 or 2' is in this case drawn by the drawing punch 78 and the blank holder 79 that surrounds said drawing punch into the in this case two-part drawing die 80, forming the third cylinder portion 84.

In other words, by contrast to the sequence of steps in FIG. 14, it is not a further cone portion 73 but a further third cylindrical portion 84 that is formed.

Figure 22B:
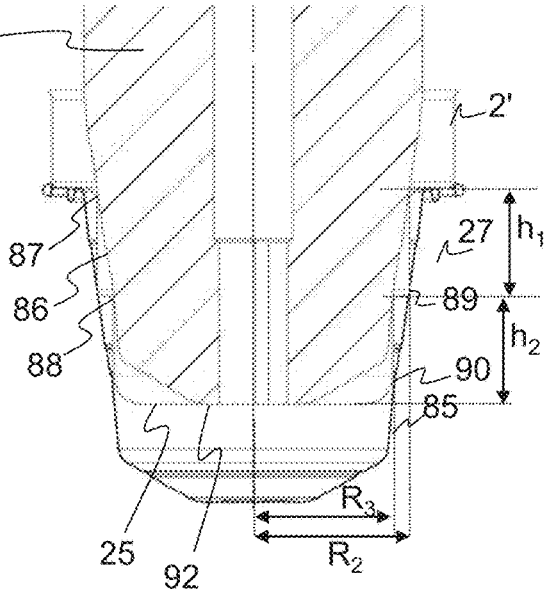

Here, the height $h_1$ of the second cylindrical portion 13, the height $h_2$ of the third cylindrical portion 84, the radius $R_2$ of the second cylindrical portion 13 and the radius $R_3$ of the third cylindrical portion 84 are selected such that, during the processing in step 65, as illustrated in FIG. 22*b*,

- the upper internal convex transition 87 between the first cylindrical region 12 and the radially extending transition portion 14 and
- the lower internal convex transition 87 between the second cylindrical region 13 and the curvedly or even radially extending transition region 14' both come into contact, from the outset, with the external contour 86 of the drawing punch 29 for the cone-forming drawing operation, which drawing punch moves into the component 2' in the cone-forming drawing operation 65.

It is furthermore preferably the case in step 71 according to the sequence of steps in FIG. 21 that the component having the third cylinder portion 84 is configured such that the base or the lower surface 92 of the cone-forming drawing operation drawing punch 29 comes into contact, from the outset, with the base 25 of the component 2'. It is thus ensured that as many contact points or contact surfaces as possible exist between drawing punch and die already at the start of the cone-forming drawing operation and during the cone-forming drawing operation, and the material is accordingly deformed as gently as possible in order that cracks can be prevented.

Furthermore, the respective heights and radii are configured such that, during the processing in step 65,

- the convex external transition region 89 between the second cylindrical region 13 and the transition region 14'
- and the convex external transition 90 between the third cylindrical region 84 and the base 82' both simultaneously come into contact, from the outset, with the drawing die 27, which forms the counterpart to the holding punch 76 and which is merely schematically illustrated in FIG. 22*b* (for illustrative purposes, the internal contour 27' of the corresponding drawing die is illustrated in FIG. 22*b* by the finished component 85).

In particular, the height and radius of the second cylindrical portion 13 may be set already during the intermediate drawing operation 64, or may be preset during said intermediate drawing operation 64 and set during the further intermediate drawing operation 71 to the desired height and the desired radius for the optimized cone-forming drawing operation 65. This method as illustrated in FIGS. 21 and 22 has, inter alia, three advantages.

1. The flange does not slip away from under the blank holder, and thus the risk of chip formation in the case of anisotropic materials is also much lower.
2. As a result of the form-fitting pre-pressing of the rolled rim in the station 5, the rolled rim is optimally rolled in the rolling station 6.
3. By means of this method, in the case of anisotropic material, the contact between the rolled rim and the rolling die occurs simultaneously around the circumference,
4. As a result of the further intermediate drawing operation, the volumes and the contact points for the next processing step are optimally prepared, and fewer creases that can then lead to side wall cracks are formed in the cone-forming drawing operation.

LIST OF REFERENCE SIGNS

| | |
|---|---|
| 1 | Blank |
| 2 | Component after intermediate drawing operation/step-forming drawing operation |
| 2' | Component after further intermediate drawing operation |
| 3 | Component after first drawing operation |
| 4 | Component after second drawing operation |
| 5 | Component after third drawing operation |
| 6 | Axis of symmetry |
| 7 | Cylindrical portion of 1 |
| 8 | Base portion of 1 |
| 9 | Curved portion of 1 between 7 and 8 |
| 10 | Folded-over rim portion of 1 |
| 11 | Stepped region of 2 |
| 11' | Stepped region of 2' |
| 12 | First cylinder portion of 11 |
| 13 | Second cylinder portion of 11 |
| 14 | Transition portion between 12 and 13 |
| 15 | Conical region of 3 |
| 16 | Conical region of 4 and 5 |
| 17 | Cylindrical region of 4 |
| 18 | Radial region of 5 |
| 19 | Cylindrical region of 5 |
| 20 | Base of 5 |
| 21 | Blank holder for intermediate drawing operation/step-forming drawing operation |
| 22 | Contact surface of 21 |
| 23 | Drawing die for intermediate drawing operation/step-forming drawing operation |
| 24 | Drawing punch for intermediate drawing operation/step-forming drawing operation |
| 24a | Front surface contour of 24 |
| 25 | Base of 2 |
| 26 | Contact surface of 23 for 22 |
| 27 | Drawing die for cone-forming drawing operation |
| 27 | Internal contour of 27' |
| 27a | Upper conical internal surface of 27 |
| 27b | Lower conical internal surface of 27 |
| 28 | Centering sleeve/blank holder for cone-forming drawing operation |
| 28a | TDC stop of 28 |
| 28b | BDC stop of 28 |
| 29 | Drawing punch for cone-forming drawing operation |
| 29a | 1st cone for conical region 15 |
| 29b | 2nd cone for conical base region 69 |
| 30 | Conical contact surface of 27 |
| 31 | Conical contact surface of 29 |
| 32 | Encircling front edge of 28 |
| 33 | Blank holder for cutting drawing operation |
| 33a | Hold-down pin of 33 |
| 34 | Hold-down pin |
| 35 | Drawing punch for cutting drawing operation |
| 36 | Cutting ring, cutting die |
| 36a | Support element of 36 and guide element of 33 |
| 36b | TDC stop of 36a |
| 36c | BDC stop of 36a |
| 36d | Guide of 36a |
| 37 | Cutting punch for cutting |

-continued

| | |
|---|---|
| | drawing operation and deep-drawing die for drawing operation for forming the blank |
| 38 | Ejector for cutting drawing operation |
| 38a | Stop element for 38 at BDC |
| 39 | Lifter |
| 39a | Spring mounting of 39 |
| 40 | Hold-down pin for emptying station |
| 41 | Upper carrier plate |
| 42 | Lower carrier plate |
| 43 | Guide cylinder between 41 and 42 |
| 44 | Curved rim region of 37 |
| 45 | Abutment block |
| 46 | Stamped piece |
| 47 | Folded-over rim of 1 |
| 48 | Hold-down pin |
| 48a | Guide pin of 48 |
| 49 | Ejector |
| 50 | Hold-down pin |
| 51 | Ejector |
| 51a | TDC stop of 51 |
| 52 | Cylindrical rim region of 3 |
| 53 | Encircling bead in 53 |
| 54 | Encircling radial flange |
| 55 | Rolled rim |
| 56 | Rolling punch |
| 57 | Rolling contour of 56 |
| 58 | Die |
| 59 | Shaped piece |
| 60 | Shaped piece |
| 61 | Rolling die |
| 62 | Stamping operation, possibly separate if the next step is not a cutting drawing operation |
| 63 | Cutting drawing operation |
| 64 | Step-forming drawing operation/intermediate drawing operation |
| 65 | Finishing drawing operation/cone-forming drawing operation |
| 66 | Groove-forming drawing operation |
| 67 | Rim rolling operation |
| 68 | Embossing operation |
| 69 | Further conical region |
| 70 | Folding punch |
| 71 | Further intermediate drawing operation |
| 72 | Further step |
| 73 | Cone portion |
| 74 | Folded-over flare |
| 75 | Contact points between 29 and 2' |
| 76 | Holding punch |
| 77 | Hold-down pin |
| 78 | Drawing punch |
| 79 | Blank holder |
| 80 | Drawing die |
| 81 | Ejector |
| 82 | Shaped contour on 58 for forming the folded-over flare |
| 82' | Base |
| 83 | Internal contour of folding punch 70 |
| 84 | Third cylinder portion of 11 |
| 85 | Finished component |
| 86 | External contour of 76 |
| 87 | Upper transition between 12 and 14 |
| 88 | Lower transition between 13 and 73/84 |
| 89 | Upper transition between 13 and 84 |
| 90 | Lower transition between 84 and 82 |
| 91 | Internal contour of the shaped piece 60 |
| 92 | Lower surface of 29 |
| $\alpha$ | Fold angle |
| $h_1$ | Height of the second cylinder portion |
| $h_2$ | Height of the third cylinder portion |
| $L_1$ | Axial length of the first cylinder portion |
| $L_2$ | Axial length of the second cylinder portion or, in the case of component 2', of the second cylinder portion and the further conical region |
| $R_1$ | Radius of the first cylinder portion 12 |
| $R_2$ | Radius of the second cylinder portion 13 |
| $R_3$ | Radius of the cone portion 73/ of the third cylinder portion 84 |
| $R_A$ | Radial width of the conical flare |
| $R_B$ | Base radius |

The invention claimed is:

1. A method for producing a component from an aluminum sheet with a thickness in the range from 0.05 to less than 0.08 mm, which component has an at least partially curvedly or linearly conical region, from a pot-shaped blank having a substantially cylindrical wall portion, wherein the method comprises at least the following steps:

a step-forming drawing operation, in which the substantially cylindrical wall portion of the blank is at least partially deformed, between a drawing die and a drawing punch that is guided movably in a blank holder, to form a stepped region having two cylinder portions, a first cylinder portion having a substantially axially extending encircling wall with a first radius and a second cylinder portion following said first cylinder portion along a component axis and having a substantially axially extending or conically converging encircling wall with a second radius that is smaller than the first radius, wherein the first and the second cylinder portion are encirclingly connected via a transition portion of the stepped region, which transition portion extends substantially radially or conically converges more acutely than the second cylinder portion, and wherein, in the step-forming drawing operation, the first cylinder portion is, at least in certain regions, guided internally by the blank holder and clamped between the blank holder and the drawing die, and the second cylinder portion is deformed by the drawing punch;

at least one directly or indirectly subsequent cone-forming drawing operation, in which at least the transition portion and the second cylinder portion of the stepped region are deformed between two tools to form the curvedly or linearly conical component portion, wherein the two tools are formed at least by a cone-forming drawing operation drawing die and a cone-forming drawing operation drawing punch that is guided movably in a cone-forming drawing operation centering sleeve, and wherein, in the cone-forming drawing operation, the first cylinder portion is, at least in certain regions, guided internally by the cone-forming drawing operation centering sleeve or clamped and/or guided between the cone-forming drawing operation centering sleeve and the cone-forming drawing operation drawing die, and the transition portion and the second cylinder portion and the transition portion are deformed between the cone-forming drawing operation drawing punch and cone-forming drawing operation drawing die, wherein, before the step-forming drawing operation, a circular stamped piece is stamped out of a flat metal sheet, and said stamped piece is deformed in a subsequent deformation step to form the pot-shaped blank having a cylindrical wall portion with a blank radius, wherein the free encircling edge of the pot-shaped blank is at least partially of curvedly conically flared form, wherein, in the cone-forming drawing operation, an encircling radial flange and an axial cylindrical rim region are formed at an opening side, and, following the cone-forming drawing operation, a drawing operation is performed in which a conical flare of the free encircling edge is form-fittingly folded over to a fold angle of at least 100° to form a folded-over flare, and, following the formation of the folded-over flare, the axial cylindrical rim region and the folded-over flare are rolled at a base side, to form a rolled rim, in a rim rolling operation by means of a rolling punch, and wherein, between the step-forming drawing operation and cone-forming drawing operation, a further intermediate drawing operation is performed in which the stepped region having two cylinder portions, the first cylinder portion having a substantially axially extending encircling wall with a first radius and the second cylinder portion following said first cylinder portion along a component axis, adjoining the base and having a substantially axially extending or conically converging encircling wall with a second radius that is smaller than the first radius, is deformed such that a further step is formed from the base or from the base and the transition between base and second cylinder portion, which further step has a cone portion or third cylinder portion, the radius of which is smaller than the second radius.

2. The method as claimed in claim 1, wherein, in the cone-forming drawing operation, an encircling radial flange and an axial cylindrical rim region are formed at an opening side, and, following the cone-forming drawing operation, a groove-forming drawing operation is performed in which an encircling bead directed toward the base is formed between a shaped piece and a die, optionally in combination with a further shaped piece, and at the same time the conical flare of the free encircling edge is form-fittingly folded over to at least 90° to form a folded-over flare, and, following the formation of the bead and the folded-over flare, the axial cylindrical rim region and the folded-over flare are rolled at a base side, to form a rolled rim, in a rim rolling operation by means of a rolling punch, wherein the rolled rim protrudes both at a base side and at an opening side beyond the plane of the flange.

3. The method as claimed in claim 1, wherein, in the drawing operation, the conical flare of the free encircling edge is form-fittingly folded over to a fold angle of at least 110°, preferably at least 120°, to form a folded-over flare.

4. The method as claimed in claim 1, wherein the conical flare has a radial width in the range from 0.5-2 mm, or in the range from 1-1.7 mm.

5. The method as claimed in claim 1, wherein, in the drawing operation, the conical flare is held form-fittingly between a folding punch and a die and is rolled to form the folded-over flare.

6. The method as claimed in claim 1, wherein, in the further intermediate drawing operation, a third cylinder portion is formed, and in the further intermediate drawing operation and/or in the step-forming drawing operation, the height and the radius of the second cylinder portion and the height and the radius of the third cylinder portion are selected such that, in the cone-forming drawing operation, the convex internal curvature regions of the component come into contact with the external contour of the cone-forming drawing operation drawing punch substantially from the outset, and the convex external curvature regions of the component come into contact with the internal contour of the drawing die of the cone-forming drawing operation substantially from the outset.

7. The method as claimed in claim 6, wherein, in the further intermediate drawing operation, the transition portion and the second cylinder portion are held form-fittingly between a blank holder and the drawing die, and the cone portion is formed by virtue of a drawing punch that is guided in the drawing die plunging into the base.

8. The method as claimed in claim 1, wherein the transition portion extends substantially encirclingly radially, and the respective encirclingly extending walls of the first and of the second cylinder portion extend substantially encirclingly axially, and/or wherein the cone-forming drawing operation centering sleeve is formed as a blank holder which, during the cone-forming drawing operation, clamps the first cylinder portion and/or the transition portion at least in certain regions between the cone-forming drawing operation blank holder and the cone-forming drawing operation drawing die.

9. The method as claimed in claim 1, wherein the ratio of the radius of the first cylinder portion to the radius of the second cylinder portion lies in the range from 2:1-1.1:1, or in the range from 1.6:1-1.25:1, or in the range from 1.5:1-1.3:1;

and/or wherein the ratio of the radius of the first cylinder portion to the base radius of the second cylinder portion or of the cone portion lies in the range from 2.5:1-1.2:1, or in the range from 2.0:1-1.4:1, or in the range from 1.9:1-1.5:1;

and/or wherein the ratio of the axial length of the first cylinder portion to the axial length of the second cylinder portion or of the second cylinder portion and the cone portion lies in the range from 4:1-0.5:1, or in the range from 3:1-0.75:1, or in the range from 2.5:1-1:1;

and/or wherein the ratio of the radius of the second cylinder portion to the base radius of the cone portion lies in the range from 2.5:1-1.1:1, or in the range from 2.0:1-1.2:1, or in the range from 1.9:1-1.3:1.

10. The method as claimed in claim 1, wherein, before the step-forming drawing operation, a preferably circular stamped piece is stamped, from a flat metal sheet, and said stamped piece is deformed in a subsequent deformation step to form the pot-shaped blank having a cylindrical wall portion with blank radius, wherein the free encircling edge of the pot-shaped blank is either folded over to form a radial flange or of curvedly conically flared form.

11. The method as claimed in claim 1, wherein the blank consists of aluminum or an aluminum alloy with a tensile strength in the range from 80-120 MPa, including aluminum of the following types: EN AW-8011A, 8079, 8176, 8021, 8090, sintered 6061 or sintered 2014, in each case in uncoated form or painted, or in color, on one side or both sides.

12. The method as claimed in claim 1, wherein the at least partially curvedly or linearly conical region forms, with the axis of symmetry of the component, an average angle in the range from 5-40°, or in the range from 7-15°, or in the range from 8-12°, and/or wherein the at least partially curvedly or linearly conical region is linearly conical at least in certain regions, and/or wherein, in the cone-forming drawing operation or in one or more subsequent deformation steps, at the base side adjoining the at least partially curvedly or linearly conical region, there is formed a further cylindrical or conical region, or, in the cone-forming drawing operation, at the base side adjoining the at least partially curvedly or linearly conical region, there is formed a further conical region, which further conical region, by comparison with the at least partially curvedly or linearly conical region, encloses a greater average angle with the axis of symmetry of the component.

13. The method as claimed in claim 1, wherein, in a transfer station, identical components are processed in parallel in the same stroke on multiple lines operating in parallel, in at least two, or 2-8, or 3-5, such parallel lines, and/or wherein the rolling operation is followed by further processing steps, including those selected from the following group: stamping steps; coating steps; application steps, including the application of inserts or attachment of seals; filling steps; quality control steps; cleaning steps; mounting steps on further components; wherein these further steps can be performed at least in part in the same transfer installation as step-forming drawing operation and cone-forming drawing operation.

14. The method as claimed in claim 1, wherein, following the formation of the folded-over flare, the axial cylindrical rim region and the folded-over flare are rolled at a base side, to form a rolled rim, in a rim rolling operation by means of a rolling punch, wherein the rolled rim protrudes both at a base side and at an opening side beyond the plane of the flange.

15. The method as claimed in claim 1, wherein, in the cone-forming drawing operation, an encircling radial flange and an axial cylindrical rim region are formed at an opening side, and, following the cone-forming drawing operation, a groove-forming drawing operation is performed in which an encircling bead directed toward the base is formed between a shaped piece and a die, in combination with a further shaped piece, and at the same time the conical flare of the free encircling edge is form-fittingly folded over to at least 90° to form a folded-over flare, and, following the formation of the bead and the folded-over flare, the axial cylindrical rim region and the folded-over flare are rolled at a base side, to form a rolled rim, in a rim rolling operation by means of a rolling punch, wherein the rolled rim protrudes both at a base side and at an opening side beyond the plane of the flange.

16. The method as claimed in claim 2, wherein, in the groove-forming drawing operation, the conical flare of the free encircling edge is form-fittingly folded over to a fold angle of at least 120°, to form a folded-over flare.

17. The method as claimed in claim 6, wherein, the height of the second cylinder portion is set to be a multiple, in the range from 0.8-1.2, of the height of the third cylinder portion, and/or wherein, the dimensions are set such that, in the cone-forming drawing operation, the base of the component comes into contact with the lower surface of the cone-forming drawing operation drawing punch substantially from the outset.

18. The method as claimed in claim 1, wherein, before the step-forming drawing operation, a circular stamped piece is stamped, in alternatingly transversely offset fashion, from a flat metal sheet that is supplied in strip form, from a roll, and said stamped piece is deformed in a subsequent deformation step to form the pot-shaped blank having a cylindrical wall portion with blank radius, wherein the free encircling edge of the pot-shaped blank is either folded over to form a radial flange or of curvedly conically flared form, wherein the outer diameter of the flare is greater than the blank radius by 1-50 times the material thickness of the metal sheet, in the case of a curvedly conically flared encircling edge, greater than the blank radius by 2-20 or 5-15 times the material thickness of the metal sheet.

19. The method as claimed in claim 1, wherein the at least partially curvedly or linearly conical region is linearly conical at least in certain regions, and has exclusively linearly conical regions aside from any steps that may be provided, and/or wherein, in the cone-forming drawing operation or in one or more subsequent deformation steps, at the base side adjoining the at least partially curvedly or linearly conical region, there is formed a further cylindrical or conical region that is connected via a radial region, or, in the cone-forming drawing operation, at the base side adjoining the at least partially curvedly or linearly conical region, there is formed a further conical region, which further conical region, by comparison with the at least partially curvedly or linearly conical region, encloses a greater average angle with the axis of symmetry of the component, a cone angle in the range from 30-80°, or in the range from 50-70°.

* * * * *